US007937019B2

(12) United States Patent
Tsusaka et al.

(10) Patent No.: US 7,937,019 B2
(45) Date of Patent: May 3, 2011

(54) IMAGE FORMING APPARATUS HAVING POWER CIRCUIT BOARD ARRANGED ON SIDE THEREOF

(75) Inventors: Shusaku Tsusaka, Nagoya (JP); Ryoichi Matsushima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/647,050

(22) Filed: Dec. 24, 2009

(65) Prior Publication Data

US 2010/0098451 A1 Apr. 22, 2010

Related U.S. Application Data

(62) Division of application No. 11/199,417, filed on Aug. 9, 2005, now Pat. No. 7,664,425.

(30) Foreign Application Priority Data

Aug. 10, 2004 (JP) ..... P2004-233699
Aug. 10, 2004 (JP) ..... P2004-233700

(51) Int. Cl.
*G03G 15/00* (2006.01)

(52) U.S. Cl. ..... 399/107

(58) Field of Classification Search ..... 399/107, 399/108
See application file for complete search history.

(56) References Cited

U.S. PATENT DOCUMENTS 5,126,788 A * 6/1992 Koga ..... 399/111
(Continued)

FOREIGN PATENT DOCUMENTS

JP 03289614 A * 12/1991
(Continued)

OTHER PUBLICATIONS

CN Office Action Dec. 14, 2007, CN Appln. No. 200510091723.8.
(Continued)

*Primary Examiner* — Quana M Grainger
(74) *Attorney, Agent, or Firm* — Banner & Witcoff, Ltd.

(57) ABSTRACT

A high-voltage circuit board and a main circuit board are arranged on the outer side surface of a left frame, and a conveyance path is provided so as to downwardly incline from a feed position near the uppermost part of the outer peripheral surface of a paper feed roller, toward an image formation position. Thus, the height position of an image forming section within a body casing can be lowered. As a result, the height of a laser printer can be made lower.

21 Claims, 27 Drawing Sheets

U.S. PATENT DOCUMENTS

| | | | |
|---|---|---|---|
| 5,345,295 | A | 9/1994 | Takano et al. |
| 5,634,178 | A | 5/1997 | Sugiura et al. |
| 6,415,118 | B1 | 7/2002 | Setoriyama et al. |
| 6,426,803 | B1 | 7/2002 | Sasai et al. |
| 6,778,197 | B2 | 8/2004 | Yamanaka |
| 6,954,610 | B2 | 10/2005 | Yamada et al. |
| 6,975,814 | B2 | 12/2005 | Tsusaka et al. |
| 7,277,658 | B2 | 10/2007 | Carter et al. |
| 2001/0033757 | A1 | 10/2001 | Sato |
| 2002/0181967 | A1 | 12/2002 | Sekine |
| 2004/0071485 | A1 | 4/2004 | Yamada et al. |
| 2004/0086286 | A1 | 5/2004 | Ishii et al. |
| 2004/0095456 | A1 | 5/2004 | Yoshihara et al. |
| 2004/0096237 | A1 | 5/2004 | Asai |
| 2004/0131378 | A1 | 7/2004 | Hattori et al. |
| 2004/0247349 | A1 | 12/2004 | Takahashi et al. |

FOREIGN PATENT DOCUMENTS

| | | | |
|---|---|---|---|
| JP | 4-226236 | A | 8/1992 |
| JP | 5-74511 | A | 3/1993 |
| JP | 5-119559 | A | 5/1993 |
| JP | 5-323698 | A | 12/1993 |
| JP | 6-115217 | A | 4/1994 |
| JP | 6-227683 | A | 8/1994 |
| JP | 6-296209 | A | 10/1994 |
| JP | 7-143300 | A | 6/1995 |
| JP | 9-114165 | A | 5/1997 |
| JP | 2000-127555 | A | 5/2000 |
| JP | 2000-275919 | A | 10/2000 |
| JP | 2001-042586 | A | 2/2001 |
| JP | 2001-042671 | A | 2/2001 |
| JP | 2001-117304 | A | 4/2001 |
| JP | 2002-338068 | A | 11/2002 |
| JP | 2002-372829 | A | 12/2002 |
| JP | 2003-195594 | A | 7/2003 |
| JP | 2004-042527 | A | 2/2004 |
| JP | 2004-077788 | A | 3/2004 |
| JP | 2004-157463 | A | 6/2004 |

OTHER PUBLICATIONS

JP Office Action dtd Jun. 3, 2008, JP Appln. 2004-233699.

JP Office Action dtd Jun. 3, 2008, JP Appln. 2004-233700.

* cited by examiner

IMAGE FORMING APPARATUS HAVING POWER CIRCUIT BOARD ARRANGED ON SIDE THEREOF

CROSS-REFERENCE TO RELATED APPLICATIONS

This application is a divisional application of prior U.S. application Ser. No. 11/199,417, filed Aug. 9, 2005, which claims priority to Japanese application nos. 2004-233699 and 2004-233700, both filed Aug. 10, 2004, the entire contents of which are incorporated herein by reference.

BACKGROUND OF THE INVENTION

1. Field of the Invention

The present invention relates to an image forming apparatus such as a laser printer.

2. Description of the Related Art

Heretofore, as an image forming apparatus such as a laser printer, there has been known one which includes a cassette capable of accommodating a plurality of sheets of paper in a stacked state, below the apparatus proper, and a paper ejection tray for ejecting the sheet of paper formed with an image, above the apparatus proper.

In such an image forming apparatus, the uppermost sheet of paper within the cassette is delivered toward the front side of the apparatus proper. Besides, the sheet of paper delivered from the cassette has its conveyance direction turned into the opposite direction at the front end part of the apparatus proper, it is conveyed toward the rear side of the apparatus proper along a conveyance path which extends in a front and rear direction above the cassette, and it is formed with the image while being conveyed along the conveyance path. The sheet of paper formed with the image has its conveyance direction turned into the opposite direction again at the rear end part of the apparatus proper, and it is ejected from behind the paper ejection tray by the paper ejection tray.

The conveyance path is provided so as to be substantially horizontal or to somewhat incline upwards toward the rear side. Therefore, a space appears between the conveyance path and the cassette, and a control circuit board and a power-source circuit board are arranged in the space, whereby the effective utilization of the space within the apparatus proper is attained (refer to, for example, JP-A-7-143300 and US2004/0095456A1).

In an image forming apparatus of electrophotographic scheme, a scanner unit for high-speed scanning with a laser beam based on image data, and a process cartridge including a charger, a photosensitive drum, a developing roller, a transfer roller, a cleaner, etc. are disposed in the apparatus proper.

In such an image forming apparatus, a high-voltage power-source circuit board which applies an electric-discharge bias, developing bias, transfer bias and cleaning bias to the charger, developing roller, transfer roller and cleaner, respectively, is disposed, and a gear plate which supports a motor for rotationally driving the photosensitive drum, developing roller, transfer roller, etc., and a gear transmission mechanism for transmitting driving forces is disposed.

There has been proposed an image forming apparatus wherein an engine-drive circuit board including a high-voltage power-source circuit portion, and a motor and a drive portion are vertically arranged on body side surfaces which are on opposite sides to each other (refer to, for example, U.S. Pat. No. 6,778,197B1).

SUMMARY OF THE INVENTION

In recent years, a request has been made for reduction in the size of an image forming apparatus, and a request has also been made for lowering the height of the image forming apparatus. With the configuration disclosed in JP-A-7-143300 and US2004/0095456A1, however, the height of the image forming apparatus is not made sufficiently low. Besides, since the circuit boards are arranged between the conveyance path and the cassette, it is difficult to make the height of the image forming apparatus still lower.

In order to reduce the size of the image forming apparatus, the inputs of driving forces and the feed of electric power to a process cartridge should desirably be done from an identical side surface in the apparatus proper. For the purpose, a high-voltage power-source circuit board and a gear plate need to be arranged on the identical side surface with respect to the process cartridge.

However, when the high-voltage power-source circuit board and the gear plate are arranged on the identical side surface with respect to the process cartridge, biases which are applied from the high-voltage power-source circuit board might leak at the periphery of the gear plate.

The present invention provides an image forming apparatus whose height can be lowered. The present invention also provides an image forming apparatus in which, notwithstanding that reduction in the size of the apparatus can be attained by arranging a high-voltage circuit board and a gear plate on an identical sidewall side, biases applied from the high-voltage circuit board at the periphery of the gear plate can be prevented from leaking.

According to a first aspect of the invention, there is provided an image forming apparatus including: a feed unit that feeds a recording medium; an image forming unit that forms an image on the recording medium fed by the feed unit; an ejection unit that ejects the recording medium on which the image is formed by the image forming unit; a power-source circuit board on which a power source that feeds electric power to the image forming unit is mounted, the power-source circuit board being arranged at least one of side portions of the image forming apparatus as viewed in a widthwise direction of the recording medium; a control circuit board on which a controller that controls the image forming unit is mounted, the control circuit board being arranged at least one of the side portions; and a conveyance path that conveys the recording medium and being inclined downwards toward an image formation position at which the image is formed by the image forming unit from a position where the recording medium fed by the feed unit separates away from the feed unit, the conveyance path being arranged that: a pickup direction that the feed unit picks up the recording medium and an image-formation-state conveyance direction that the conveyance path conveys the recording medium at the image formation position are configured to be opposite with each other; and the image formation-state conveyance direction and an ejection direction that the ejection unit ejects the recording medium on which the image is formed by the image forming unit are configured to be opposite with each other.

According to a second aspect of the invention, there is provided an image forming apparatus including: a first sidewall and a second sidewall that are arranged in opposition at a predetermined interval therebetween; an image forming unit that forms an image on a recording medium and being arranged between the first sidewall and the second sidewall; a drive source that is arranged on a side of the first sidewall with respect to the image forming unit, and generates a driving force for the image forming unit; a first gear that transmits the driving force from the drive source to the image forming unit; a gear plate that is arranged on a side of the first sidewall with respect to the image forming unit, and supports the first gear; a high-voltage circuit board that generates a bias to be applied to the image forming unit, and is arranged in opposition to the gear plate on a side of the first sidewall with respect to the image forming unit, the high-voltage circuit board having a displaced portion that is displaced from the gear plate in an opposing direction of the first sidewall and the second sidewall; and a supply-voltage output terminal that outputs the bias and provided on the high-voltage circuit board at the displaced portion.

BRIEF DESCRIPTION OF THE DRAWINGS

In the accompanying drawings:

FIGS. 27A and 27B show side views for explaining the advancing and retreating operations of a coupling member shown in FIG. 25, wherein FIG. 27A illustrates the advance state of the coupling member, and FIG. 27B illustrates the retreat state of the coupling member.

DETAILED DESCRIPTION OF THE EMBODIMENTS

Embodiments of the invention will be described below with reference to the drawings.

First Embodiment

Figure 1:
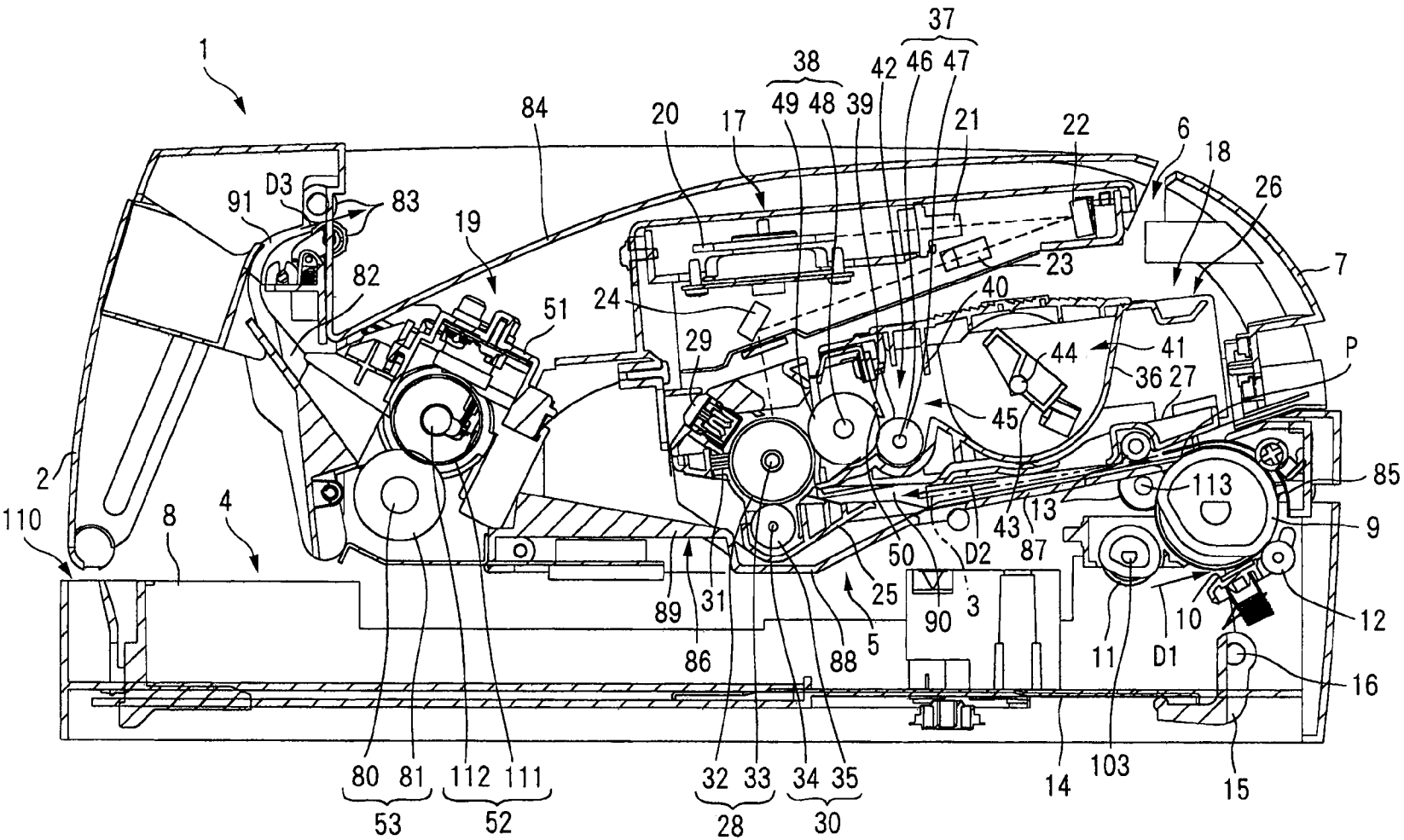
FIG. 1 is a side sectional view of essential portions showing a first embodiment of a laser printer which is the image forming apparatus of the present invention, and illustrating a case where a front cover is closed.
Figure 2:
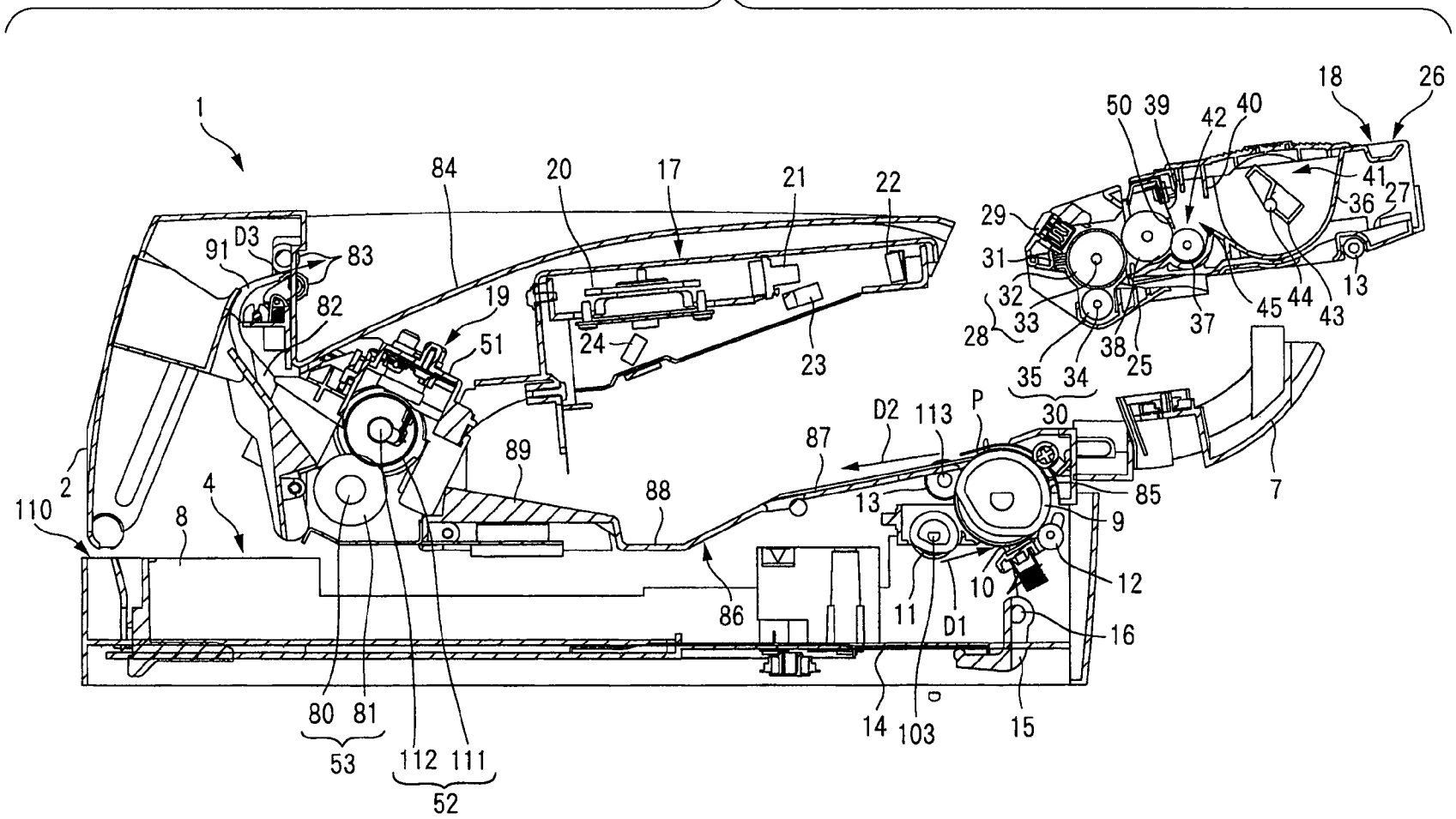
FIG. 2 is a side sectional view of the essential portions of the laser printer shown in FIG. 1, and illustrating a state where the front cover is opened.

FIGS. 1 and 2 are side sectional views of essential portions showing a first embodiment of a laser printer which is the image forming apparatus of the present invention. The laser printer 1 includes within a body casing 2, a feeder section 4 for feeding paper 3 which is a recording medium, and an image forming section 5 that forms an image on the fed paper 3.

In the body casing 2, an attachment/detachment opening 6 for attaching and detaching a process cartridge 18 to be described below is formed in the sidewall of one side, and a front cover 7 for opening and closing the attachment/detachment opening 6 is provided.

The front cover 7 is turnably supported on a cover shaft, not shown, which is inserted through the lower end part thereof. Thus, when the front cover 7 is closed about the cover shaft, the attachment/detachment opening 6 is closed by the front cover 7 as shown in FIG. 1, and when the front cover 7 is opened (inclined down) with the cover shaft as a fulcrum, the attachment/detachment opening 6 is opened as shown in FIG. 2, and the process cartridge 18 can be attached to or detached from the body casing 2 through the attachment/detachment opening 6.

In the ensuing description, in each of the laser printer 1 and the process cartridge 18 (including a developing cartridge 26 to be described later), a side on which the front cover 7 is disposed shall be termed "front side", and the opposite side "rear side".

The feeder section 4 includes at a bottom part in the body casing 2, a paper feed tray 8 which is removably mounted in a tray accommodation space 110 that is opened extending in a front and rear direction, a paper feed roller 9 and a separation pad 10 which are disposed above the front end part of the paper feed tray 8, a pickup roller 11 which is disposed on the rear side of the paper feed roller 9, a pinch roller 12 which is arranged below the front side of the paper feed roller in opposition to the paper feed roller, and registration rollers 13 which are disposed above the rear side of the paper feed roller 9.

Included inside the paper feed tray 8 is a paper presser plate 14 which is made of a metal, and on which the sheets of paper 3 can be put in stacked fashion. The paper presser plate 14 is swingably supported at its rear end part, whereby the front end part thereof is movable in an up and down direction.

A lever 15 for lifting up the front end part of the paper presser plate 14 is disposed at the front end part of the paper feed tray 8. The lever 15 is formed substantially in the shape of letter L as viewed in section, so as to turn under the paper presser plate 14 from the front side of the paper presser plate. The upper end part of the lever 15 is mounted on a lever shaft 16 which is disposed at the front end part of the paper feed tray 8, while the rear end part thereof abuts on the front end part of the lower surface of the paper presser plate 14. Thus, when a turning drive force which is clockwise as viewed in the figures is input to the lever shaft 16, the lever 15 turns with a fulcrum at the lever shaft 16, and the rear end part of the lever 15 lifts up the front end part of the paper presser plate 14.

When the front end part of the paper presser plate 14 is lifted up, the uppermost sheets of paper 3 on the paper presser plate 14 are pressed against the pickup roller 11 and are picked up by the rotation of the pickup roller 11, and the picked-up sheet of paper 3 are delivered in a pickup direction D1 toward the space between the paper feed roller 9, which lies in front of and somewhat above the pickup roller 11, and the separation pad 10.

When the paper feed tray 8 is dismounted from the body casing 2, the paper presser plate 14 has its front end part moved downwards by its own weight, and it falls into a state where it extends along the bottom surface of the paper feed tray 8. In the state, the sheets of paper 3 can be put on the paper presser plate 14 in the stacked fashion.

Above the front side of the paper feed roller 9, a circularly-arcuate guide member 85 whose section is substantially in the shape of a quarter circular arc is arranged so as to conceal the region of the outer peripheral surface of the paper feed roller 9 between the frontmost position and uppermost position thereof. More specifically, the circularly-arcuate guide member 85 is formed in the shape of a curved plate which is curved along the outer peripheral surface of the paper feed roller 9, and whose section is substantially in the shape of the quarter circular arc. The guide member 85 is disposed with a minute substantially-equal spacing relative to the region of the outer peripheral surface of the paper feed roller 9 between the frontmost position and the uppermost position thereof.

The sheets of paper 3 delivered in the pickup direction D1 by the pickup roller 11 are reliably separated one by one when they are interposed between the paper feed roller 9 and the separation pad 10. Thereafter, the sheet of paper 3 is conveyed toward the space between the paper feed roller 9 and the pinch roller 12 by the rotation of the paper feed roller 9. Besides, the sheet of paper 3 having passed through the space between the paper feed roller 9 and the pinch roller advances into the space between the paper feed roller 9 and the circularly-arcuate guide member 85, and it is conveyed along the outer peripheral surface of the paper feed roller 9 between the paper feed roller 9 and the circularly-arcuate guide member 85. Thus, the conveyance direction of the sheet of paper 3 is turned from the pickup direction D1 of the sheet of paper 3 between the paper feed roller 9 and the separation pad 10, to an image-formation-state conveyance direction D2 which is a rearward direction opposite to the pickup direction D1.

A resin-made guide plate 86 which extends in the front and rear direction, is disposed in rear of the paper feed roller 9. The guide plate 86 includes an upstream side portion 87 which inclines down rearwards from the vicinity of the upper part of the paper feed roller 9, an intermediate portion 88 which is joined to the rear side of the upstream side portion 87 which is formed in a concave shape concealing a transfer roller 30 to be described later, from below, and a downstream portion 89 which is joined to the rear side of the intermediate portion 88 and which has an upper surface inclining up rearwards.

The registration rollers 13 are constructed of a pair of upper and lower rollers opposite each other. They are arranged in a state where the lower roller protrudes above the upper surface of the guide plate 86 at the front end part of the upstream side portion 87 of the guide plate 86, and the upper roller is held in pressed touch with the lower roller.

The sheet of paper 3 which is conveyed between the paper feed roller 9 and the separation pad 10, separates away from the outer peripheral surface of the paper feed roller 9 at a feed position P near the top part of the outer peripheral surface of the paper feed roller 9 so as to be fed onto the upstream side portion 87 of the guide plate 86. Besides, after registration based on the registration rollers 13, the sheet of paper 3 fed onto the upstream side portion 87 of the guide plate 86 is conveyed in a downwardly inclining direction rearwards on the upstream side portion 87 of the guide plate 86 and along the upper surface of the upstream side portion 87 by the rotations of the registration rollers 13, and it is conveyed toward the image formation position of the image forming section 5 (the nip position between a photosensitive drum 28 to be described later and the transfer roller 30, at which a toner image on the photosensitive drum 28 is transferred onto the sheet of paper 3). That is, a conveyance path 90 which extends from the feed position P near the top part of the outer peripheral surface of the paper feed roller 9, to the image formation position, and which inclines down from the space between the outer peripheral surface of the paper feed roller 9 and the circularly-arcuate guide member 85, toward the space between the photosensitive drum 28 and the transfer roller 30, is formed on the upstream side portion 87 of the guide plate 86.

The image forming section 5 includes a scanner portion 17, the process cartridge 18, and a fixation portion 19.

The scanner portion 17 is disposed at an upper part within the body casing 2, and it includes a laser light source which is not shown, a polygonal mirror 20 which is driven to rotate, an fθ lens 21, a reflector 22, a lens 23, and a reflector 24. A laser beam which is emitted from the laser light source and which is based on image data is deflected by the polygonal mirror 20 and is passed through the fθ lens 21 as indicated by a chain line. Thereafter, the optical path of the laser beam is turned by the reflector 22 and is passed through the lens 23. Further, the optical path is crooked downwards by the reflector 24. Thus, the laser beam is projected by high-speed scanning onto the surface of the photosensitive drum 28 of the process cartridge 18 as described later.

The process cartridge 18 is detachably attached to the body casing 2 under the scanner portion 17. The process cartridge 18 includes a drum cartridge 25, and the developing cartridge 26 which is detachably attached to the drum cartridge 25.

The drum cartridge 25 is such that, between a pair of side plates 27 each of which extends in the front and rear direction and which are arranged so as to oppose to each other in the widthwise direction of the sheet of paper 3 in the laser printer 1 as is orthogonal to the front and rear direction (herein below, simply termed "widthwise direction"), the developing cartridge 26 is attached on the front side, while the photosensitive drum 28, a scorotron charger 29, the transfer roller 30 that serves as a transfer unit, and a cleaning brush 31 are disposed on the rear side.

The photosensitive drum 28 includes a cylindrical drum body 32 whose outermost surface layer is formed of a positively-charged photosensitive layer made of polycarbonate, etc., and a metal-made drum shaft 33 which extends in the lengthwise direction of the drum body 32 along the axis of the drum body 32. The drum shaft 33 is unrotatably supported by both the side plates 27 of the drum cartridge 25, and the drum body 32 is supported so as to be rotatable relative to the drum shaft 33, whereby the photosensitive drum 28 is disposed so as to be rotatable about the drum shaft 33 between both the side plates 27.

The scorotron charger 29 is arranged is arranged in opposition to the photosensitive drum 28 with a spacing so as not to touch the photosensitive drum 28, obliquely above the rear side of the photosensitive drum 28. The scorotron charger 29 is a charger of positively-charging scorotron type which includes a charging wire and a grid of tungsten or the like. A discharge bias is applied from a high-voltage circuit board 95 to be described later, to the charging wire, and a grid bias is applied from the high-voltage circuit board 95 to the grid, whereby corona discharge is generated so as to uniformly charge the surface of the photosensitive drum 28 to the positive polarity.

The transfer roller 30 is rotatably supported by both the side plates 27 of the drum cartridge 25, and it is arranged so as to lie in opposition to and touch with the photosensitive drum 28 from the lower side in the up and down direction and to form a nip between the transfer roller and the photosensitive drum 28. The transfer roller 30 is constructed in such a way that a metal-made roller shaft 34 is covered with a roller 35 which is made of an electrically-conductive rubber material. A transfer bias is applied from the high-voltage circuit board 95 to be described later, to the transfer roller 30.

The cleaning brush 31 is arranged in a state where the distal end of the brush touches the surface of the drum body 32 of the photosensitive drum 28 in rear of the photosensitive drum 28. A cleaning bias is applied from the high-voltage circuit board 95 to be described later, to the cleaning brush 31.

The developing cartridge 26 is detachably attached to the drum cartridge 25, and it includes a box-shaped housing 36 whose rear side is opened, and a feed roller 37, a developing roller 38 and a layer-thickness regulation blade 39 which are disposed in the housing 36. The developing cartridge 26 can be attached to or detached from the body casing 2 unitarily with the drum cartridge 25.

Inside the housing 36, a partition plate 40 which protrudes downwards from the upper surface of the housing is provided extending in the widthwise direction, midway in the front and rear direction, and an internal space in front of the partition plate 40 is used as a toner accommodation chamber 41, while an internal space in rear of the partition plate 40 is used as a developing chamber 42.

In the toner accommodation chamber 41, a nonmagnetic single-component toner of positively-charging property is accommodated as a developing agent. Used as the toner is a polymerized toner which is obtained in such a way that polymerizable monomers, for example, a styrenic monomer such as styrene and an acrylic monomer such as acrylic acid, alkyl (C1-C4) acrylate or alkyl (C1-C4) methacrylate are copolymerized by a known polymerization method such as suspension polymerization. Such a polymerized toner is globular and exhibits a very good fluidity, and it can achieve image formation of high image quality.

Incidentally, a coloring agent such as carbon black, a wax, etc. are compounded in such a toner, and an additive such as silica is added in order to enhance the fluidity. The grain diameter of the toner is about 6-10 μm.

Besides, an agitator 43 for stirring the toner within the toner accommodation chamber 41 is disposed in the toner accommodation chamber 41. The agitator 43 is supported by an agitator rotating shaft 44 which extends in the widthwise direction at the central part of the toner accommodation chamber 41, and the agitator 43 is rotated with the agitator rotating shaft 44 as a fulcrum, whereby the toner in the toner accommodation chamber 41 is stirred and is emitted toward the developing chamber 42 from a toner emission port 45 underlying the partition plate 40.

Within the developing chamber 42, the feed roller 37 is rotatably supported between both side plates which are arranged at front lower parts and which oppose in the widthwise direction of the housing 36. The feed roller 37 includes a feed roller shaft 46 which is made of a metal and which extends in the widthwise direction, and a sponge roller 47 which is made of an electrically-conductive foamed material and which covers the periphery of the feed roller shaft 46.

Within the developing chamber 42, the developing roller 38 is rotatably supported between both side plates which are arranged at rear lower parts and which oppose in the widthwise direction of the housing 36. Besides, the developing roller 38 is arranged so that part of its surface may be exposed protruding rearwards from the housing 36, and it lies in opposition to and touch with the photosensitive drum 28 in the front and rear direction in a state where the developing cartridge 26 is attached to the drum cartridge 25. The developing roller 38 includes a developing roller shaft 48 which is made of a metal, and a rubber roller 49 which is made of an electrically-conductive rubber material and which covers the periphery of the developing roller shaft 48. The rubber roller 49 is made of electrically-conductive urethane rubber or silicone rubber containing carbon particles or the likes, and its surface is covered with fluorinated urethane rubber or silicone rubber. Besides, the rubber roller 49 is arranged in touch with the sponge roller 47 of the feed roller 37 so as to be compressed on each other. A developing bias is applied to the developing roller 38 from the high-voltage circuit board 95 to be described later.

The layer-thickness regulation blade 39 is made of a metallic leaf spring member, and it is provided at its distal end part with a pressing rubber member 50 of semicircular section which is made of insulating silicone rubber. The layer-thickness regulation blade 39 is supported by the housing 36 above the developing roller 38, and its lower end part opposes to the rubber roller 49 of the developing roller 38 from the front side, whereby the pressing rubber member 50 is brought into pressed touch with the rubber roller by the elastic force of the layer-thickness regulation blade 39.

The toner which is emitted from the toner emission port 45 into the developing chamber 42 by the rotation of the agitator 43 is fed onto the rubber roller 49 of the developing roller 38 by the rotation of the feed roller 37. On this occasion, the toner is frictionally charged into the positive polarity between the sponge roller 47 of the feed roller 37 and the rubber roller 49 of the developing roller 38. The toner fed onto the rubber roller 49 advances into the space between the rubber roller 49 and the pressing rubber member 50 of the layer-thickness blade 39 with the rotation of the developing roller 38, and it becomes a thin layer of predetermined thickness so as to be carried on the rubber roller 49.

The surface of the photosensitive drum 28 is positively charged uniformly by the scorotron charger 29 and is thereafter exposed to light by the high-speed scanning with the laser beam from the scanner portion 17, thereby to be formed with an electrostatic latent image based on the image data.

Subsequently, when the toner which is carried on the rubber roller 49 of the developing roller 38 and which is positively charged is brought into opposition to and touch with the photosensitive drum 28 by the rotation of the developing roller 38, it is fed to the electrostatic latent image which is formed on the surface of the photosensitive drum 28, that is, the exposed part which has been exposed to the light by the laser beam and whose electric potential is lower, in the surface of the photosensitive drum 28 positively charged uniformly, and it is selectively carried, thereby to be turned into a visible image. Thus, the toner image is formed by reversal developing.

Thereafter, the photosensitive drum 28 and the transfer roller 30 are driven and rotated so as to interpose therebetween and convey the sheet of paper 3 conveyed from the conveyance path 90, and the sheet of paper 3 is conveyed between the photosensitive drum 28 and the transfer roller 30, whereby the toner image carried on the surface of the photosensitive drum 28 is transferred onto the sheet of paper 3.

After the transfer, paper powder which has adhered to the surface of the photosensitive drum 28 due to the touch of the photosensitive drum with the sheet of paper 3 is removed by the brush of the cleaning brush 31 when the surface of the photosensitive drum 28 has opposed to the cleaning brush 31 with the rotation of the photosensitive drum 28.

The fixation portion 19 is disposed on the rear side of the downstream side portion 89 of the guide plate 86 (a downstream side in the conveyance direction D2 in the image formation mode), and it includes a fixation frame 51 which extends in the widthwise direction, and a heating roller 52 and a pressing roller 53 which are rotatably supported by the fixation frame 51 and which are arranged in opposition in the up and down direction.

The heating roller 52 includes a metallic elementary pipe 111, and a heating halogen lamp 112 disposed in the metallic elementary pipe 111, and it is driven to rotate by the input of power from a motor not shown.

The pressing roller 53 is arranged under the heating roller 52 and in opposition thereto so as to press the heating roller 52. The pressing roller 53 is constructed in such a way that a metal-made roller shaft 80 is covered with a roller 81 made of a rubber material, and it is driven in accordance with the rotating drive of the heating roller 52.

The sheet of paper 3 on which the toner image has been transferred is conveyed in an upwardly inclining direction rearwards on the downstream side portion 89 of the guide plate 86 and along the upper surface of the downstream side portion 89 by the rotations of the photosensitive drum 28 and the transfer roller 30. Besides, the sheet of paper 3 advances into the fixation frame 51 and passes through the space between the heating roller 52 and the pressing roller 53. On this occasion, the toner transferred on the sheet of paper 3 is thermally fixed on the sheet of paper 3 by heating based on the heating roller 52 and pressure application based on the pressing roller 53.

On the rear side of the fixation portion 19, there are formed an inclined paper-ejection path 82 which is extended rearwards and which is inclined upwards at an angle larger than that of the upper surface of the guide plate 86, and a curved paper-ejection path 91 which is curved substantially in a C-shaped section from the rear end edge of the inclined paper-ejection path 82. Paper ejection rollers 83 that serve as an ejection unit is arranged at the upper end of the curved paper-ejection path 91.

The sheet of paper 3 on which the toner has been fixed in the fixation portion 19 is sent to the inclined paper-ejection path 82, is passed through the inclined paper-ejection path 82 and is further passed through the bent paper-ejection path 91, by the rotations of the heating roller 52 and the pressing roller 53. When the sheet of paper 3 has arrived at the paper ejection rollers 83, and it is ejected in a frontward ejection direction D3 opposite to the image-formation-state conveyance direction D2 and is ejected onto a paper ejection tray 84 formed on the upper surface of the body casing 2, by the rotations of the paper ejection rollers 83.

Figure 3:
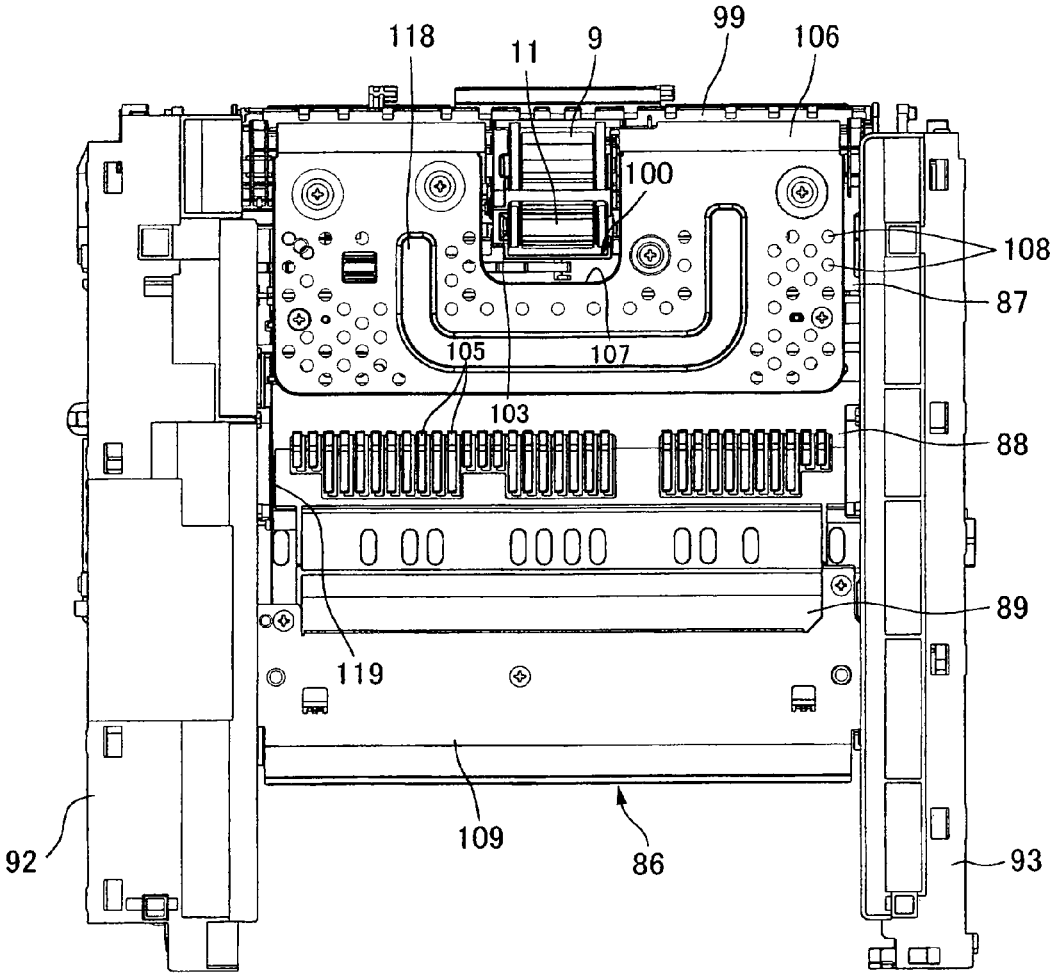
FIG. 3 is a view showing the upper part of a tray accommodation space in a state where the paper feed tray has been dismounted from a body casing shown in FIG. 1.

FIG. 3 is a view showing the upper part of the tray accommodation space 110 in the state where the paper feed tray 8 has been dismounted from the body casing 2. The body casing 2 is provided with a left frame 92 and a right frame 93 which are made of a resin, and which are arranged so as to oppose in the widthwise direction. Besides, the guide plate 86 is extended between the left frame 92 and the right frame 93, and the process cartridge 18 (refer to FIG. 1) is attached over the guide plate 86.

Figure 4:
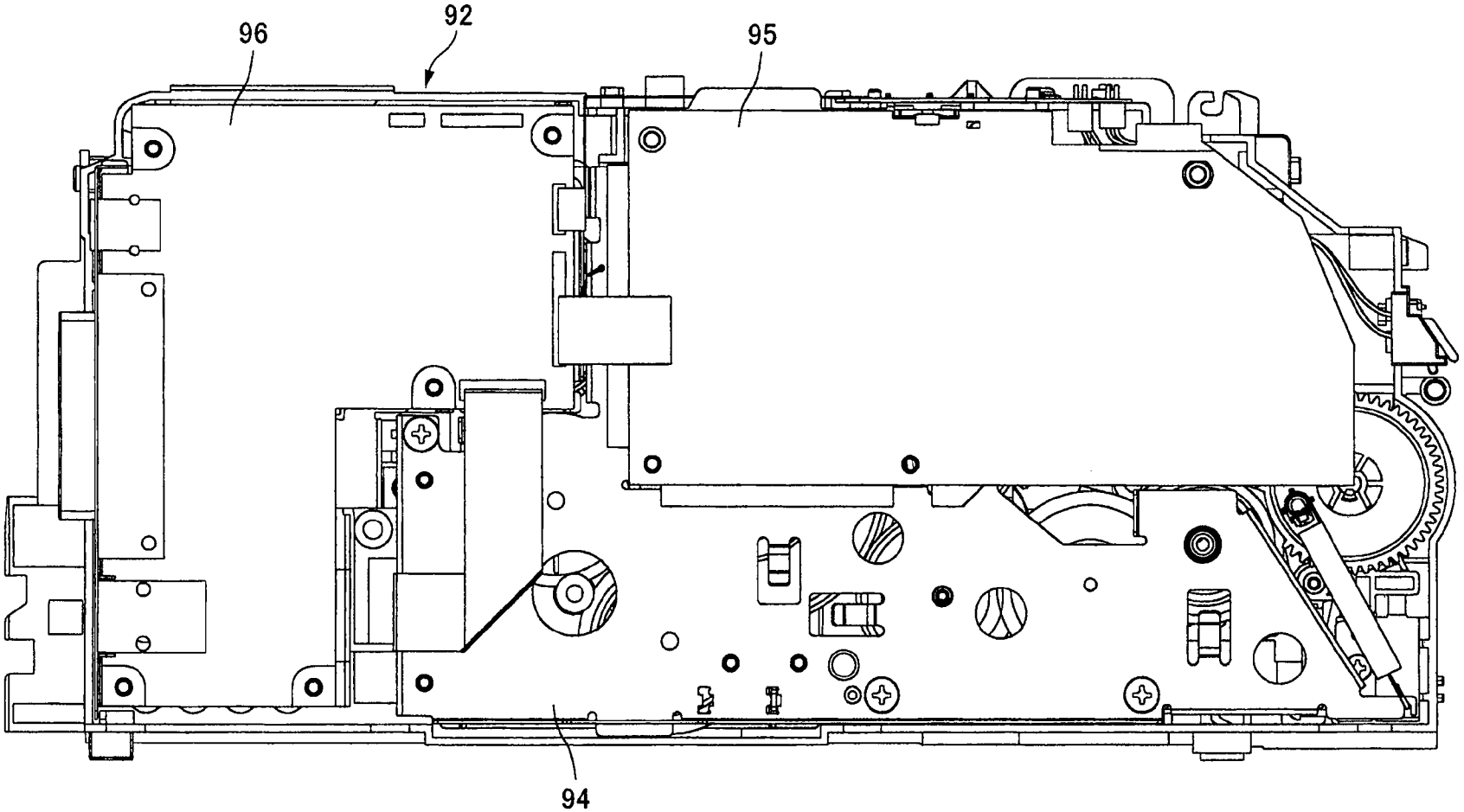
FIG. 4 is an outer side view of a left frame shown in FIG. 3.

As shown in FIG. 4, the left frame 92 forms a substantially oblong shape extending in the front and rear direction, inside elevation, and a gear plate 94, the high-voltage circuit board 95 being a power-source circuit board, and a main circuit board 96 being a control circuit board are arranged on the outer side surface.

The gear plate 94 is made of a sheet metal, and it supports gears for transmitting the driving forces from the motors not shown, to the process cartridge 18, etc. The gear plate 94 is arranged so as to extend rearwards from the front end edge of the left frame 92 and along the lower end edge of the outer side surface of the left frame 92 so that the side surface on which the gears are arranged may face the outer side surface of the left frame 92.

The high-voltage circuit board 95 is a mounted power-source circuit board for boosting the voltage of single phase and 100 V fed from the exterior of the laser printer 1, so as to generate the high-voltage biases which are respectively applied to the scorotron charger 29, transfer roller 30, cleaning brush 31 and developing roller 38. The high-voltage circuit board 95 is arranged in opposition to the gear plate 94 from a widthwise outer side so that, at the front upper part of the outer side surface of the left frame 92, the surface on which transformers are mounted may face the outer side surface of the left frame 92, while the lower end part of the circuit board 95 may overlap the upper end part of the gear plate 94.

The main circuit board 96 is the control circuit board which includes a CPU for controlling the operations of the various portions of the laser printer 1. The main circuit board 96 is formed substantially in the shape of letter L as viewed in side elevation, and it is arranged in a space which is formed on the rear side of the gear plate 94 as well as the high-voltage circuit board 95, in the outer side surface of the left frame 92, so that the main circuit board may not overlap the gear plate 94 or the high-voltage circuit board 95.

Figure 5:
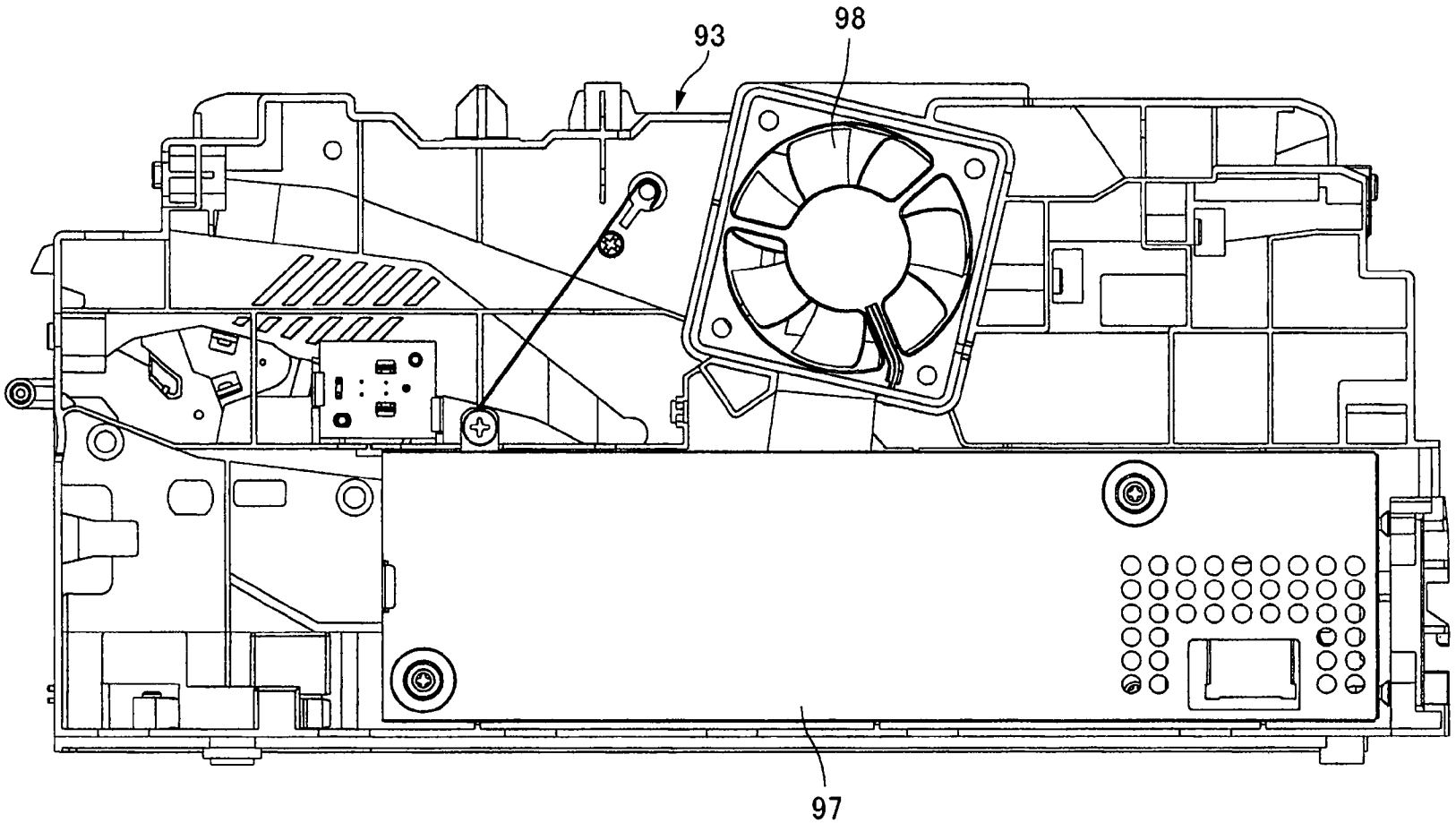
FIG. 5 is an inner side view of a right frame shown in FIG. 3.

As shown in FIG. 5, the right frame 93 forms a substantially oblong shape extending in the front and rear direction as viewed in side elevation, and a low-voltage circuit board 97 and a fan 98 are arranged on the outer side surface of the right frame 93.

The low-voltage circuit board 97 is a power-source circuit board for stepping down the voltage of single phase and 100 V fed from the exterior of the laser printer 1, so as to generate low voltages for driving the motors not shown. The low-voltage circuit board 97 is arranged so that the surface of the circuit board on which transformers etc. are mounted may face the outer side surface of the right frame 93, and that the circuit board may extend frontward from the rear end edge of the right frame 93 along the lower end edge thereof.

The fan 98 serves to emit generated heat from the process cartridge 18 and the fixation portion 1 out of the body casing 2, and is arranged so as to bring the widthwise inner side and widthwise outer side of the right frame 93 into communication, midway in the front and rear direction of the right frame 93 and over the low-voltage circuit board 97.

Figure 6:
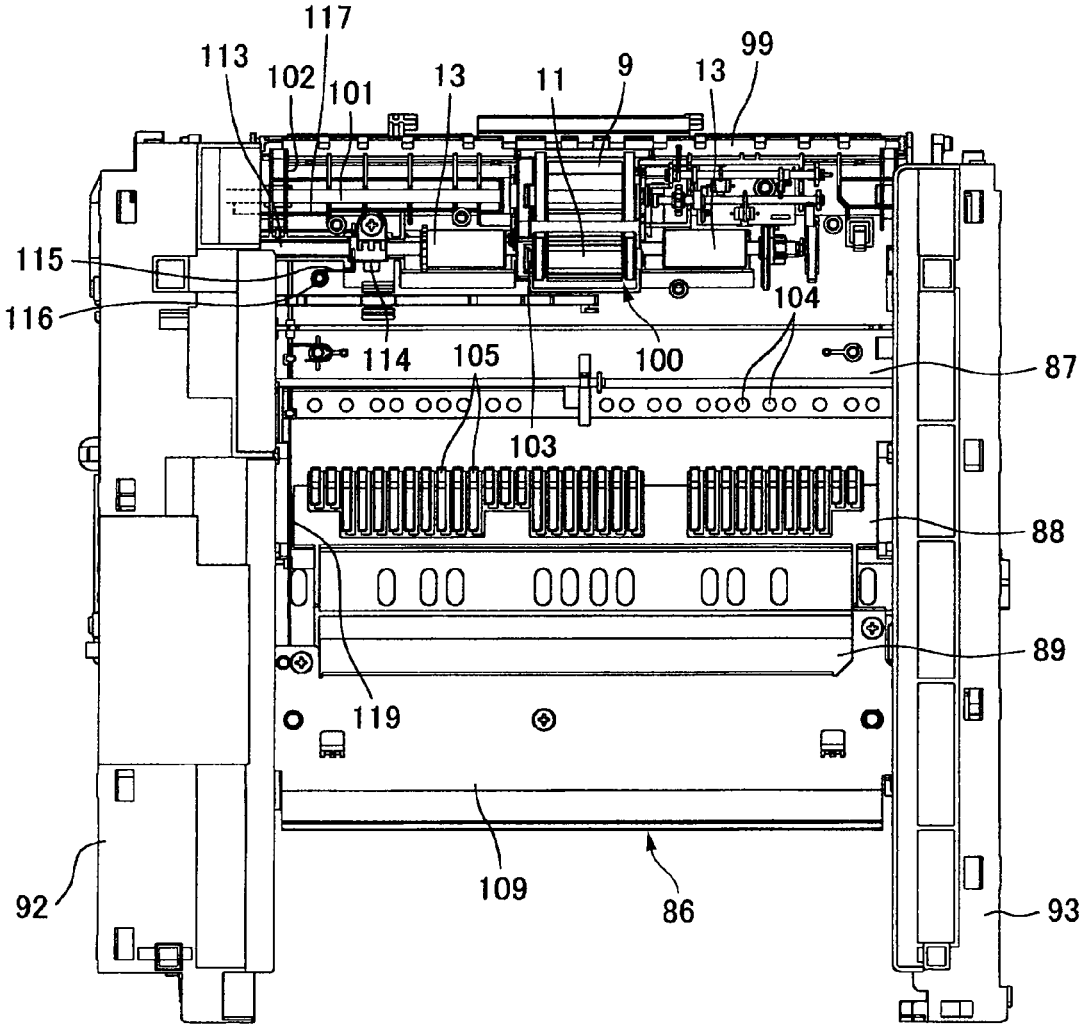
FIG. 6 is a view showing the upper part of the tray accommodation space in the state where the paper feed tray has been dismounted from the body casing shown in FIG. 1, and illustrating a state where a reinforcement plate has been detached.

As shown in FIG. 6, the guide plate 86 includes a roller support portion 99 which is joined in front of the upstream side portion 87, and which rotatably supports the paper feed roller 9, pickup roller 11 and registration rollers 13.

A cut-away portion 100 which penetrates in the up and down direction is formed at the widthwise central part of the roller support portion 99, and the paper feed roller 9 and the pickup roller 11 serving as feed unit are juxtaposed in the front and rear direction in the cut-away portion 100. More specifically, the paper feed roller 9 is supported by the right end part of a paper feed roller shaft 101 which is made of a metal and which extends in the widthwise direction from the left frame 92, and it is rotatably disposed in the cut-away portion 100 in such a way that the paper feed roller shaft 101 is rotatably inserted through the left sidewall of the cut-away portion 100 and a bearing rib 102 which is suspended from the lower surface of the guide plate 86. Besides, the pickup roller 11 is supported by a pickup roller shaft 103 which extends in the widthwise direction, and it is rotatably disposed in the cut-away portion 100 in such a way that the pickup roller shaft 103 is rotatably received by both the widthwise sidewalls of the cut-away portion 100.

The registration rollers 13 are disposed over the pickup roller 11 and on both the widthwise sides of the pickup roller 11 in a bottom view, and it is supported by a registration roller shaft 113 which is made of a metal and which extends in the widthwise direction from the left frame 92.

The registration roller shaft 113 is rotatably supported by an electrically-conductive bearing 114 made of an electrically-conductive material, between the left frame 92 and the left registration roller 13. Besides, one end of a grounding conductor 115 is connected to the electrically-conductive bearing 114. The other end of the grounding conductor 115 is wound round the outer peripheral surface of a boss 116. When a reinforcement plate 106 to be explained below is mounted so as to abut on the boss 116 extending downwards from the lower surface of the guide plate 86, the other end of the grounding conductor 115 comes into touch with the reinforcement plate 106. Besides, one end of a grounding conductor 117 for the paper feed roller is connected to the paper feed roller shaft 101, and the other end of the grounding conductor 117 for the paper feed roller is connected to the electrically-conductive bearing 114. Thus, the paper feed roller shaft 101 and the registration roller shaft 113 are electrically connected to the reinforcement plate 106, the reinforcement plate 106 is electrically connected with a thermal shield plate 109 to be described below, through a wiring line 119, and the thermal shield plate 109 is electrically connected to the ground terminals of the low-voltage circuit board 97 and the main circuit board 96 through wiring lines not shown, thereby to be grounded.

In the rear part of the upstream side portion 87 of the guide plate 86, a plurality of circular holes 104 which are first ventilation holes for venting air in the up and down direction through the upstream side portion 87 are formed in a row in the widthwise direction.

Further, in the intermediate portion 88 of the guide plate 86, a plurality of rectangular holes 105 which are third ventilation holes for venting air in the up and down direction through the intermediate portion 88 are formed in juxtaposition in the widthwise direction.

As shown in FIG. 3, the reinforcement plate 106 which is made of a sheet metal for reinforcing the guide plate 86, and the thermal shield plate 109 which is made of a sheet metal for cutting off heat emission from the fixation portion 19 are disposed under the guide plate 86.

The reinforcement plate 106 is arranged in opposition to the upstream side portion 87 of the guide plate 86 and the roller support portion 99, it extends in the widthwise direction of the guide plate 96, and it is formed substantially in the shape of an oblong plate which extends from the front end edge of the guide plate to the side of the formation position of the rectangular holes 105 of the guide plate 86. That is, the reinforcement plate 106 covers the upstream side portion 87 of the guide plate 86 and the roller support portion 99 from below, and its rear end edge (its downstream-side end edge in the image-formation-state conveyance direction) is located on the front side (upstream side in the image-formation-state conveyance direction) relative to the rectangular holes 105 formed in the intermediate portion 88 of the guide plate 86.

The reinforcement plate 106 is formed with a cut-away hole 107 at a position opposite the cut-away portion 100, by cutting away the reinforcement plate 106 from its front end edge in a substantially rectangular shape as viewed in plan. Thus, the paper feed roller 9 and the pickup roller 11 are exposed below through the cut-away hole 107. In other words, the reinforcement plate 106 is disposed so that its parts on both the sides of the cut-away hole 107 in the widthwise direction may hold the paper feed roller 9 and the pickup roller 11 therebetween from both the outer sides in the widthwise direction.

The reinforcement plate 106 is formed with a plurality of circular holes 108 which are second ventilation holes for venting air in the up and down direction through the reinforcement plate 106 so as to allow ventilation for the circular holes 104 formed in the guide plate 86. The plurality of circular holes 108 are formed so that the total open area thereof may become larger than the total open area of the plurality of circular holes 104 formed in the guide plate 86. Besides, the plurality of circular holes 104 are formed as polka dots in that part of the reinforcement plate 106 which opposes to the upstream side portion 87 of the guide plate 86.

A recess 118 which is substantially formed in U-lettered shape as viewed in plan and which serves to increase the strength of the reinforcement plate 106 is formed in the reinforcement plate 106 so as to be concave downwards and to surround the cut-away hole 107.

The thermal shield plate 109 is arranged in opposition to the downstream side portion 89 of the guide plate 86 with a predetermined spacing from the reinforcement plate 106 in the front and rear direction, and it is formed substantially in the shape of an oblong plate which extends in the widthwise direction of the guide plate 86. That is, the thermal shield plate 109 is disposed so as to cover the downstream portion 89 of the guide plate 86 from below. Thus, the thermal shield plate 109 cuts off the heat emission from the fixing portion 19, thereby to prevent the heat emission from being transmitted to the sheets of paper 3 within the paper feed tray 8 mounted below the guide plate 86.

As described above, in the laser printer 1, the high-voltage circuit board 95 and the main circuit board 96 are arranged on the outer side surface of the left frame 92, and they are not arranged under the conveyance path 90. Therefore, the conveyance path 90 can be formed so as to downwardly incline from the feed position P toward the image formation position, and the height position of the image forming section 5 in the body casing 2 can be consequently lowered. As a result, the height of the laser printer 1 can be lowered. Further, since both the high-voltage circuit board 95 and the main circuit board 96 are arranged on the left frame 92, the widthwise dimension of the laser printer 1 can be reduced.

In a configuration in which the high-voltage circuit board 95 are not arranged on the lower surface of the guide plate 86, a sheet metal for shielding the high-voltage circuit board 95, etc. is not disposed on the lower surface of the guide plate 86, either, and hence, the strength of the guide plate 86 might become low. In contrast, with the configuration of the laser printer 1, the reinforcement plate 106 is disposed on the lower surface of the guide plate 86, and hence, the strength of the guide plate 86 can be increased. Therefore, the deformation etc. of the guide plate 86 are preventable.

Since the reinforcement plate 106 is made of the sheet metal, the strength of the resin-made guide plate 86 can be reliably enhanced.

The paper feed roller 9 and the pickup roller 11 are supported by the roller support portion 99 of the guide plate 86, so that the roller support portion 99 is loaded when these rollers are driven. Since, however, the reinforcement plate 106 is disposed, the deformation of the roller support portion 99 are preventable.

Since the paper feed roller 9 and the pickup roller 11 are arranged in the cut-away portion 100 formed in the widthwise central part of the roller support portion 99, the height of the laser printer 1 can be made still lower than in a configuration in which the paper feed roller 9 and the pickup roller 11 are arranged under the guide plate 86.

The cut-away hole 107 is formed in the reinforcement plate 106, and both the widthwise side parts of the reinforcement plate 106 relative to the cut-away hole 107 are located so as to hold the paper feed roller 9 and the pickup roller 11 therebetween from both the widthwise outer sides. Therefore, the surroundings of the cut-away portion 100 of the roller support portion 99 of the guide plate 86 can be reliably reinforced, and the deformation etc. of the roller support portion 99 are preventable more.

Since the recess 118 is formed in the reinforcement plate 106, the strength of the reinforcement plate 106 can be increased. Therefore, the surroundings of the cut-away portion 100 of the roller support portion 99 of the guide plate 86 can be more reliably reinforced, and the deformation etc. of the roller support portion 99 are preventable still more.

Since the plurality of circular holes 108 are formed in the reinforcement plate 106, the ventilation based on the plurality of circular holes 104 formed in the rear part of the upstream side portion 87 of the guide plate can be prevented from being hindered by the reinforcement plate 106.

Since the total open area of the plurality of circular holes 108 of the reinforcement plate 106 is larger than that of the plurality of circular holes 104 formed in the guide plate 86, the ventilation based on the circular holes 104 can be more reliably prevented from being hindered by the reinforcement plate 106.

An air stream which emits the generated heat from the process cartridge 18, out of the body casing 2, can be developed by the fan 98 arranged on the right frame 93, and an air stream from the circular holes 108 toward the circular holes 104 can be developed within the body casing 2 in consequence of the development of the first-mentioned air stream. Therefore, the interior of the body casing 2 can be sufficiently ventilated.

Since the plurality of rectangular holes 105 are formed in the intermediate portion 88 of the guide plate 86, the surrounding atmosphere of the transfer roller 30 can be ventilated through the rectangular holes 105. Therefore, stable transfer can be achieved.

Since the reinforcement plate 106 has its rear end edge located on the front side relative to the rectangular holes 105 formed in the intermediate portion 88 of the guide plate 86, the rectangular holes 105 can be prevented from being closed by the reinforcement plate 106. Therefore, ventilation based on the rectangular holes 105 can be ensured.

Since the reinforcement plate 106 is grounded, electric charges can be prevented from being stored in the reinforcement plate 106. Therefore, electric discharge from the reinforcement plate 106 is preventable, and the deterioration of an image quality attributed to such electric discharge is preventable.

Since the paper feed roller shaft 101 and the registration roller shaft 113 are also grounded, electric charges can be prevented from being stored in these shafts. Moreover, since the paper feed roller shaft 101 and the registration roller shaft 113 are grounded through the reinforcement plate 106 disposed near these shafts, wiring structures for grounding the paper feed roller 9 and the pickup roller 11 can be simplified.

Second Embodiment

Figure 7:
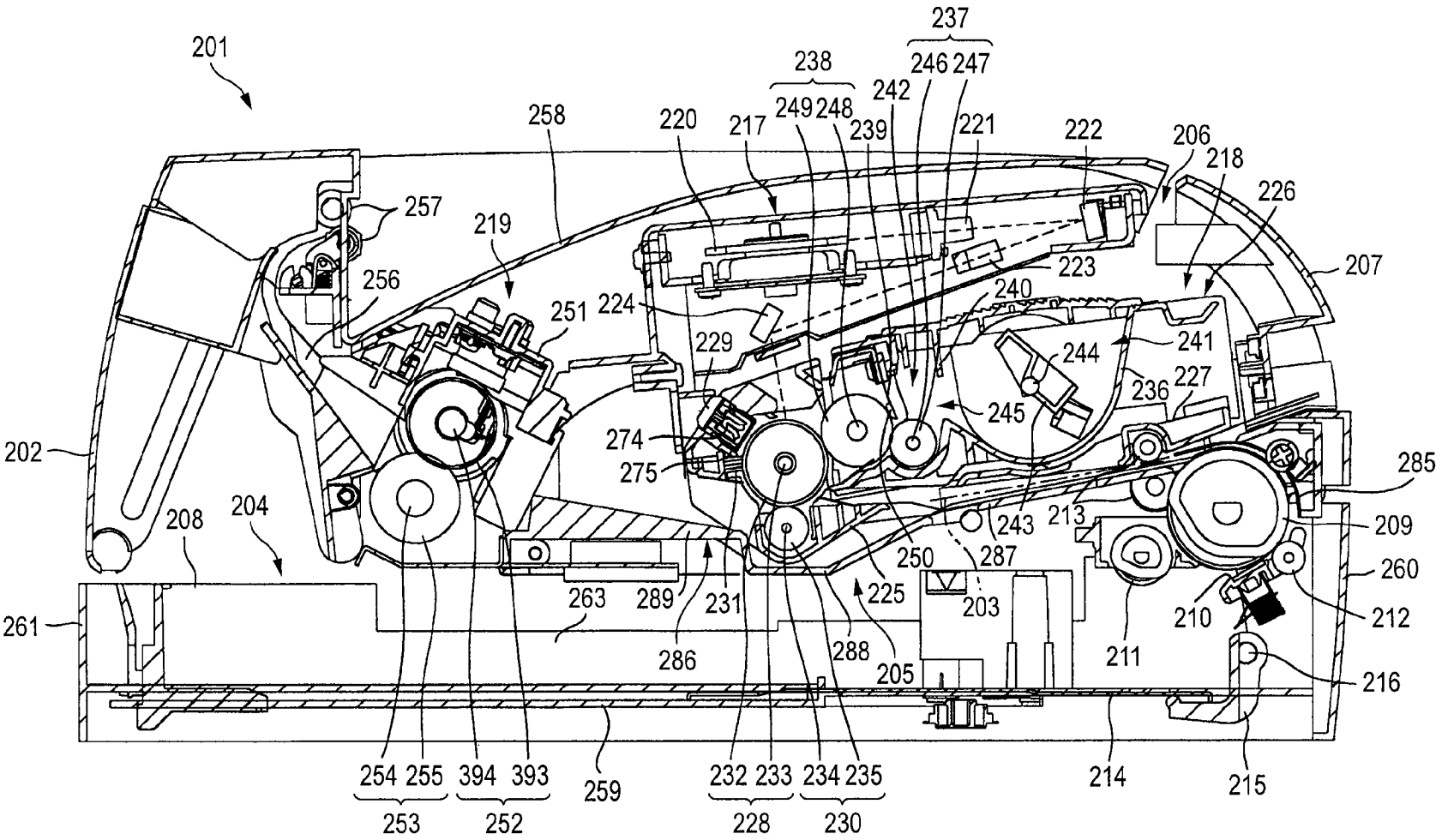
FIG. 7 is a side sectional view of essential portions showing a second embodiment of a laser printer which is the image forming apparatus of the present invention, and it illustrates a case where a front cover is closed.
Figure 8:
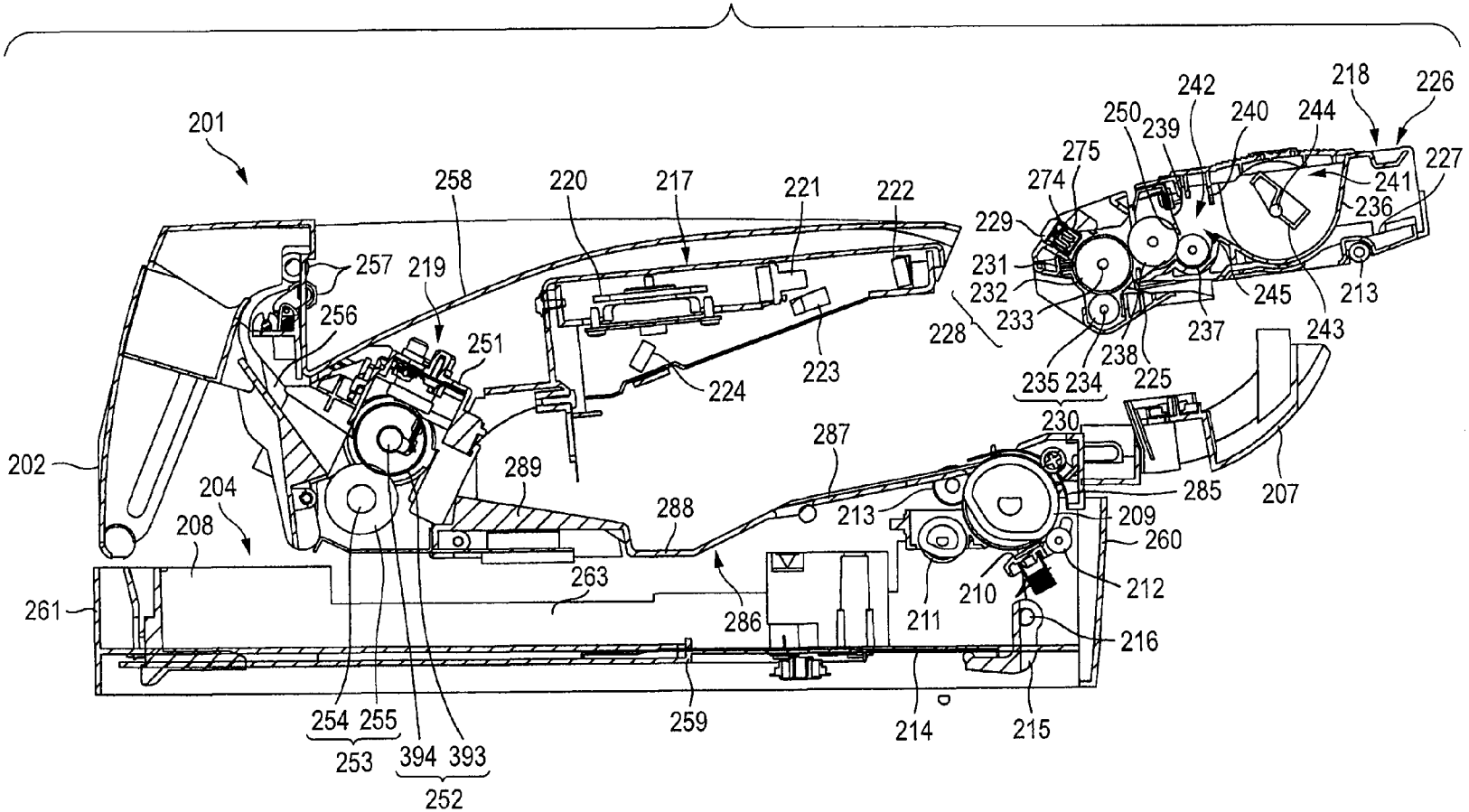
FIG. 8 is a side sectional view of the essential portions of the laser printer shown in FIG. 7, and it illustrates a state where the front cover is opened.

FIGS. 7 and 8 are side sectional views of essential portions showing a second embodiment of a laser printer which is the image forming apparatus of the present invention. The laser printer 201 includes within a body casing 202, a feeder section 204 for feeding paper 203 as a recording medium, an image forming section 205 that forms an image on the fed paper 203.

In the body casing 202, an attachment/detachment opening 206 for attaching and detaching a process cartridge 218 to be described below is formed in the sidewall of one side, and a front cover 207 for opening and closing the attachment/detachment opening 206 is provided.

The front cover 207 is turnably supported on a cover shaft, not shown, which is inserted through the lower end part thereof. Thus, when the front cover 207 is closed about the cover shaft, the attachment/detachment opening 206 is closed by the front cover 207 as shown in FIG. 7, and when the front cover 207 is opened (inclined down) with the cover shaft as a fulcrum, the attachment/detachment opening 206 is opened as shown in FIG. 8, and the process cartridge 218 can be attached to or detached from the body casing 202 through the attachment/detachment opening 206.

In the ensuing description, in each of the laser printer 201 and the process cartridge 218 (including a developing cartridge 226 to be described later), a side on which the front cover 207 is disposed shall be termed "front side", and the opposite side "rear side".

The feeder section 204 includes at a bottom part in the body casing 202, a paper feed tray 208 which is removably mounted in a tray accommodation space 310 that is opened extending in a front and rear direction, a paper feed roller 209 and a separation pad 210 which are disposed above the front end part of the paper feed tray 208, a pickup roller 211 which is disposed on the rear side of the paper feed roller 209, a pinch roller 212 which is arranged below the front side of the paper feed roller 209 in opposition to the paper feed roller 209, and registration rollers 213 which are disposed above the rear side of the paper feed roller 209.

As shown in FIGS. 7-10, the paper feed tray 208 unitarily includes a bottom plate 259 which is in the shape of a rectangular plate as viewed in plan, and a front wall 260, a rear wall 261, a left sidewall 262 and a right sidewall 263 which surround a space on the bottom plate 259 and which are vertically erected from the peripheral end edges of the bottom plate 259, respectively.

Figure 9:
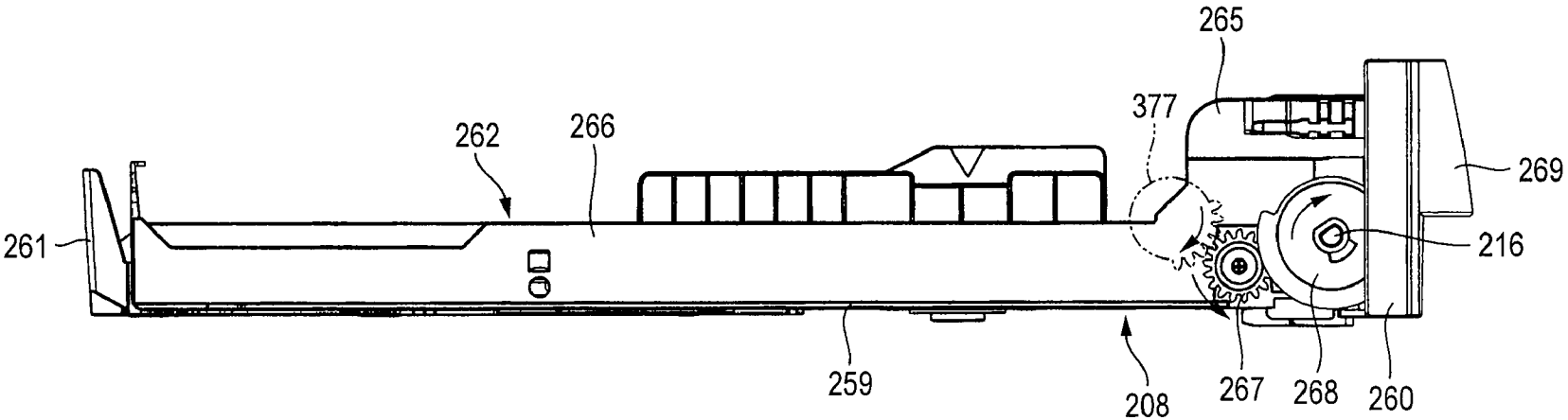
FIG. 9 is a left side view of a paper feed tray shown in FIG. 7.
Figure 10:
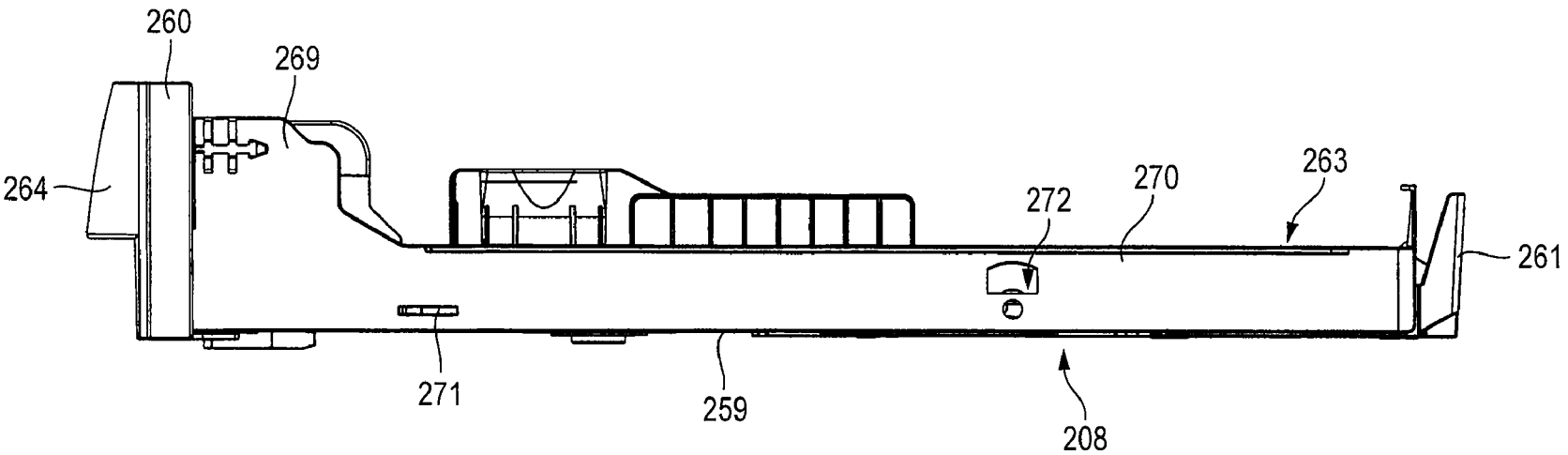
FIG. 10 is a right side view of the paper feed tray shown in FIG. 7.

The front wall 260 is joined to the front end edge of the bottom plate 259. As shown in FIGS. 9 and 10, the front wall 260 is formed with a grasp portion 264 which is substantially triangular as viewed in side elevation. The grasp portion 264 is grasped, and the paper feed tray 208 is slid in a front and rear direction relative to the body casing 202, whereby the paper feed tray 208 can be dismounted from the body casing 202 or mounted in the body casing 202.

The rear wall 261 is joined to the rear end edge of the bottom plate 259.

As shown in FIG. 9, the left sidewall 262 is joined to the left end edge of the bottom plate 259, and it includes a gear arrangement portion 265 which is substantially rectangular as viewed in side elevation, and a left-wall rear portion 266 which is formed to be lower in height than the gear arrangement portion 265 and which extends rearwards from the gear arrangement portion 265. In the gear arrangement portion 265, there are arranged an input gear 267 which meshes with a lever-driving-force transmission gear 377 disposed in the body casing 202 and to be described later, when the paper feed tray 208 has been mounted in the body casing 202, and a lever drive gear 268 which is meshed with the input gear 267 and which is rotated by a driving force transmitted from the input gear 267.

As shown in FIG. 10, the right sidewall 263 is joined to the right end edge of the bottom plate 259, and includes a right-wall front portion 269 which is substantially rectangular as viewed in side elevation, and a right-wall rear portion 270 which is formed to be lower in height than the right-wall front portion 269 and which extends rearwards from the rear end part of the right-wall front portion 269. The front end part of the right-wall rear portion 270 is provided with a lock-piece engagement portion 271 which is a lock mechanism being substantially triangular as viewed in side elevation, and with which a tray lock piece 279 to be described later is held in engagement when the paper feed tray 208 has been mounted in the body casing 202. Also, the intermediate part of the right-wall rear portion 270 in the front and rear direction is formed with a ground connection hole 272 into which a presser-plate ground contact 383 to be described later is fitted when the paper feed tray 208 has been mounted in the body casing 202.

As shown in FIGS. 7 and 8, the paper feed tray 208 includes a paper presser plate 214 which is a metal-made placement plate capable of placing the sheets of paper 203 in stacked fashion, on the bottom plate 259, and a lever 215 which serves to lift the front end part of the paper presser plate 214 upwards, on the front side of the paper presser plate 214.

The paper presser plate 214 is swingably supported at its rear end part, whereby the front end part thereof is movable in an up and down direction.

The lever 215 is formed substantially formed in L-lettered shape as viewed in section, so as to turn under the paper presser plate 214 from the front side of the paper presser plate. The upper end part of the lever 215 is mounted on a lever shaft 216 that extends in a direction (herein below, termed "widthwise direction") orthogonal to the front and rear direction, while the rear end part thereof abuts on the front end part of the lower surface of the paper presser plate 214. Besides, the lever shaft 216 penetrates through the left sidewall 262 and protrudes out of the left sidewall 262 in the widthwise direction, and the lever drive gear 268 is relatively unrotatably mounted on the left end part of the lever shaft 216 protruding from the left sidewall 262. The lever shaft 216 is rotatably supported by a rib not shown, over the bottom plate 259.

When the paper feed roller 208 is mounted in the body casing 202, the lever-driving-force transmission gear 377 to be described later, disposed in the body casing 202 is meshed with the input gear 267. When a driving force is input from the lever-driving-force transmission gear 377 to the input gear 267 in the meshed state, the lever 215 turns with a fulcrum at the lever shaft 216, in consequence of the rotation of the input gear 267, and the rear end part of the lever 215 lifts up the front end part of the paper presser plate 214.

When the front end part of the paper presser plate 214 is lifted up, the uppermost sheets of paper 203 on the paper presser plate 214 are pressed against the pickup roller 211 and are begun to be conveyed toward the space between the paper feed roller 209 and the separation pad 210, by the rotation of the pickup roller 211.

When the paper feed tray 208 is dismounted from the body casing 202, the mesh between the input gear 267 and the lever-driving-force transmission gear 377 is released, and the paper presser plate 214 has its front end part moved downwards by its own weight, to fall into a state where the paper presser plate 214 extends along the bottom plate 259 of the paper feed tray 208. In this state, the sheets of paper 203 can be placed on the paper presser plate 214 in the stacked fashion.

Above the front side of the paper feed roller 209, a circularly-arcuate guide member 285 whose section is substantially in the shape of a quarter circular arc is arranged so as to conceal the region of the outer peripheral surface of the paper feed roller 209 between the frontmost position and uppermost position thereof. More specifically, the circularly-arcuate guide member 285 is formed in the shape of a curved plate which is curved along the outer peripheral surface of the paper feed roller 209, and whose section is substantially in the shape of the quarter circular arc. The guide member 285 is disposed with a minute substantially-equal spacing relative to the region of the outer peripheral surface of the paper feed roller 209 between the frontmost position and the uppermost position thereof.

The sheets of paper 203 delivered by the pickup roller 211 are reliably separated one by one when they are interposed between the paper feed roller 209 and the separation pad 210. Thereafter, the sheet of paper 203 is conveyed toward the space between the paper feed roller 209 and the pinch roller 212 by the rotation of the paper feed roller 209. The sheet of paper 203 having passed through the space between the paper feed roller 209 and the pinch roller 212 advances into the space between the paper feed roller 209 and the circularly-arcuate guide member 285, and it is conveyed along the outer peripheral surface of the paper feed roller 209 between the paper feed roller 209 and the circularly-arcuate guide member 285.

A resin-made guide plate 286 that extends in the front and rear direction, is disposed in rear of the paper feed roller 209. The guide plate 286 includes an upstream side portion 287 that inclines down rearwards from the vicinity of the upper part of the paper feed roller 209, an intermediate portion 288 which is joined to the rear side of the upstream side portion 287 which is formed in a concave shape concealing a transfer roller 230 to be described later, from below, and a downstream portion 289 which is joined to the rear side of the intermediate portion 288 and which has an upper surface inclining up rearwards.

The registration rollers 213 include a pair of upper and lower rollers opposite each other. They are arranged in a state where the lower roller protrudes above the upper surface of the guide plate 286 at the front end part of the upstream side portion 287 of the guide plate 286, and the upper roller is held in pressed touch with the lower roller.

The sheet of paper 203 which is conveyed between the paper feed roller 209 and the separation pad 210, separates away from the outer peripheral surface of the paper feed roller 209, near the top part of the outer peripheral surface of the paper feed roller 209 so as to be fed onto the upstream side portion 287 of the guide plate 286. After registration based on the registration rollers 213, the sheet of paper 203 fed onto the upstream side portion 287 of the guide plate 286 is conveyed on the upstream side portion 287 of the guide plate 286 and toward the image formation position of the image forming section 205 (the nip position between a photosensitive drum 228 to be described later and the transfer roller 230, at which a toner image on the photosensitive drum 228 is transferred onto the sheet of paper 203), by the rotations of the registration rollers 213.

The image forming section 205 includes a scanner portion 217, the process cartridge 218, and a fixation portion 219.

The scanner portion 217 is disposed at an upper part within the body casing 202, and includes a laser light source which is not shown, a polygonal mirror 220 which is driven to rotate, an fθ lens 221, a reflector 222, a lens 223, a and reflector 224. A laser beam which is emitted from the laser light source and which is based on image data, is deflected by the polygonal mirror 220 and is passed through the fθ lens 221 as indicated by a chain line. Thereafter, the optical path of the laser beam is turned by the reflector 222 and is passed through the lens 223. Further, the optical path is crooked downwards by the reflector 224. Thus, the laser beam is projected by high-speed scanning onto the surface of the photosensitive drum 228 of the process cartridge 218 as described later.

The process cartridge 218 is detachably attached to the body casing 202 under the scanner portion 217. The process cartridge 218 includes a drum cartridge 225, and a developing cartridge 226 which is detachably attached to the drum cartridge 225.

Figure 11:
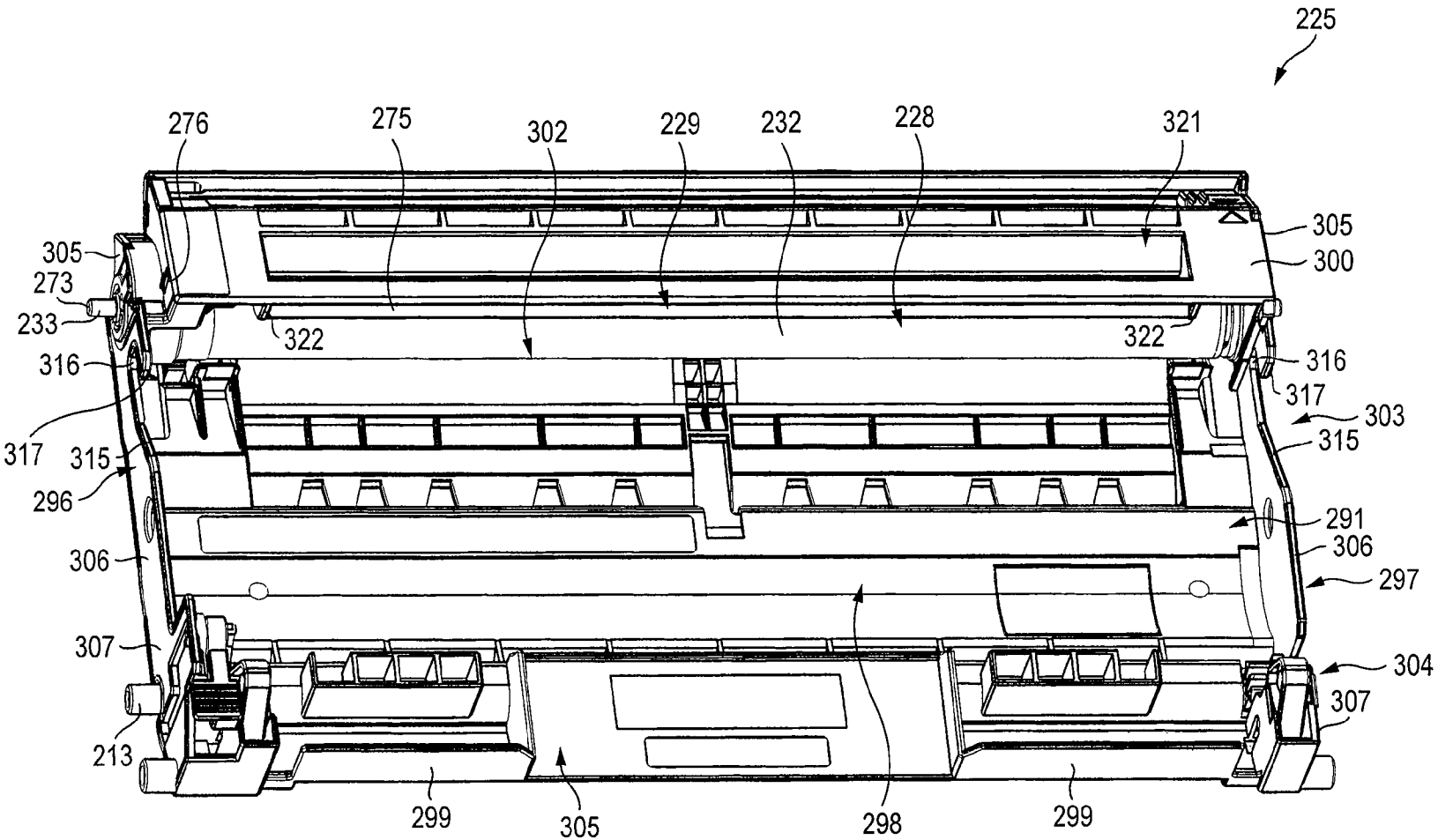
FIG. 11 is a perspective view of a drum cartridge shown in FIG. 7.
Figure 12:
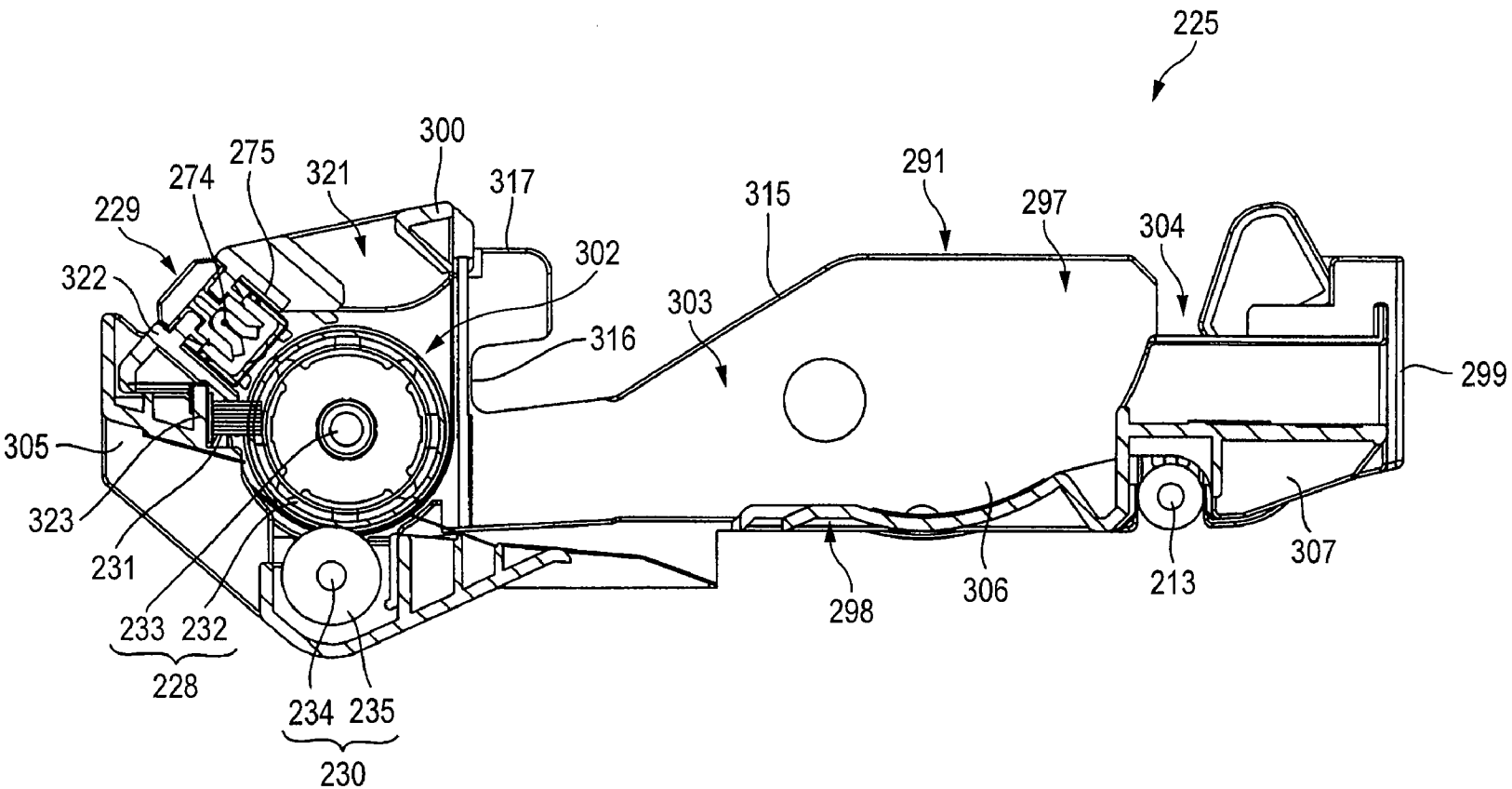
FIG. 12 is a side sectional view of the drum cartridge shown in FIG. 11.

As shown in FIGS. 11 and 12, the drum cartridge 225 includes a cartridge frame 291, and process members which are disposed in the cartridge frame 291, namely, the photosensitive drum 228 being a photosensitive member, a scorotron charger 229 that serves as a charging unit, the transfer roller 230 that serves as a transfer unit, and a cleaning brush 231 that serves as a cleaning unit.

The cartridge frame 291 unitarily includes a left sidewall 296, a right sidewall 297, a bottom wall 298, a front wall 299 and a rear upper wall 300.

The left sidewall 296 and the right sidewall 297 are arranged in opposition at a widthwise interval therebetween. Each of these sidewalls is such that a rear sidewall portion 205 which is substantially in the shape of a bow as viewed in side elevation, a front sidewall portion 306 which is substantially rectangular as viewed in side elevation, and an extension sidewall portion 307 which is substantially rectangular as viewed in side elevation are continuously formed in succession from the rear side of the corresponding sidewall toward the front side thereof.

The front sidewall portion 306 includes a roller-shaft guide portion 315 which serves to guide the shaft end part of a developing roller shaft 248 to be described later, when the developing cartridge 226 is detached, and a roller-shaft acceptance portion 316 which is disposed in continuation to the rear end of the roller-shaft guide portion 315 and which accepts the shaft end part of the developing roller shaft 248 guided by the roller-shaft guide portion 315.

The roller-shaft guide portion 315 is formed as the upper end edge of the front sidewall portion 306, and is formed so as to extend rearwards from the intermediate part of the front sidewall portion 306 in the front and rear direction and to incline downwards, and to thereafter extend in the shape of a flat substantially in a horizontal direction.

The roller-shaft acceptance portion 316 is continuous to the rear side of the roller-shaft guide portion 315. The roller-shaft acceptance portion 316 is formed in a protrusive wall 317 which protrudes above the rear end part of the roller-shaft guide portion 315, by cutting away the protrusive wall 317 from the front end edge thereof and substantially in a rectangular shape as viewed in side elevation. The lower end edge of the roller-shaft acceptance portion 316 is continuous to the rear end edge of the roller-shaft guide portion 315.

The extension sidewall portion 307 is flush with the front sidewall portion 306 in the widthwise direction, and it is formed in continuation to the front sidewall portion 306.

The bottom wall 298 is substantially in the shape of a flat plate, and it is disposed so as to join the lower end edges of the left sidewall 296 and the right sidewall 297 in the front and rear direction.

The front wall 299 is formed so as to be orthogonally bent upwards from the front end edge of the bottom wall 298. The front wall 299 is substantially in the shape of rectangular flat plates, and it is formed in continuation to the left sidewall 296 and the right sidewall 297 so that both its widthwise end parts may be bent in a direction orthogonal to these sidewalls.

The rear upper wall 300 is formed in a plate shape which is inclined down rearwards, and it is disposed so as to join the upper end edges of the respective rear sidewall portions 305 of the left sidewall 296 and right sidewall 297, in the front and rear direction. The rear upper wall 300 has its rear end edge joined with the rear end edge of the bottom wall 298 in the widthwise direction. Besides, the rear upper wall 300 is provided in its front part with a laser entrance window 321 which extends in the widthwise direction and which is substantially rectangular as viewed in plan. The rear upper wall 300 is unitarily formed with charging support portions 322 for supporting the scorotron charger 229, at the oblique upper parts of the rear part of the rear upper wall, and a brush support portion 323 for supporting the cleaning brush 231, at the inner side part of the rear part.

In the cartridge frame 291, a drum accommodation portion 302 is defined as a closed space whose front part is open, by the respective rear sidewall portions 305 of the left sidewall 296 and right sidewall 297, the rear upper wall 300, and the rear parts of the bottom wall 298 as oppose to the rear upper wall 300 in the up and down direction. A developing-cartridge accommodation portion 303 is defined as a space whose upper part is open, whose front part communicates with an extension portion 304 to be described below, and whose rear part communicates with the drum accommodation portion 302, by the respective front sidewall portions 306 of the left sidewall 296 and right sidewall 297, and the intermediate parts of the bottom wall 298 in the front and rear direction as are continuous to the respective front sidewall portions 306 in the widthwise direction. Further, the extension portion 304 is defined as a space whose upper part is open and whose rear part communicates with the developing-cartridge accommodation portion 303, by the extension sidewall portions 307 of the left sidewall 296 and right sidewall 297, the front parts of the bottom wall 298 as are continuous to the respective extension sidewall portions 307 in the widthwise direction, and the front wall 299.

As shown in FIG. 12, the photosensitive drum 228 is disposed within the drum accommodation portion 302. The photosensitive drum 228 includes a cylindrical drum body 232 whose outermost surface layer is formed of a positively-charged photosensitive layer made of material such as polycarbonate, and a metal-made drum shaft 233 which extends in the lengthwise direction of the drum body 232 along the axis of the drum body 232. The drum shaft 233 is unrotatably supported by both the side plates 227 of the drum cartridge 225, and the drum body 232 is supported so as to be rotatable relative to the drum shaft 233, whereby the photosensitive drum 228 is disposed so as to be rotatable about the drum shaft 233 between both the side plates 227.

Figure 13:
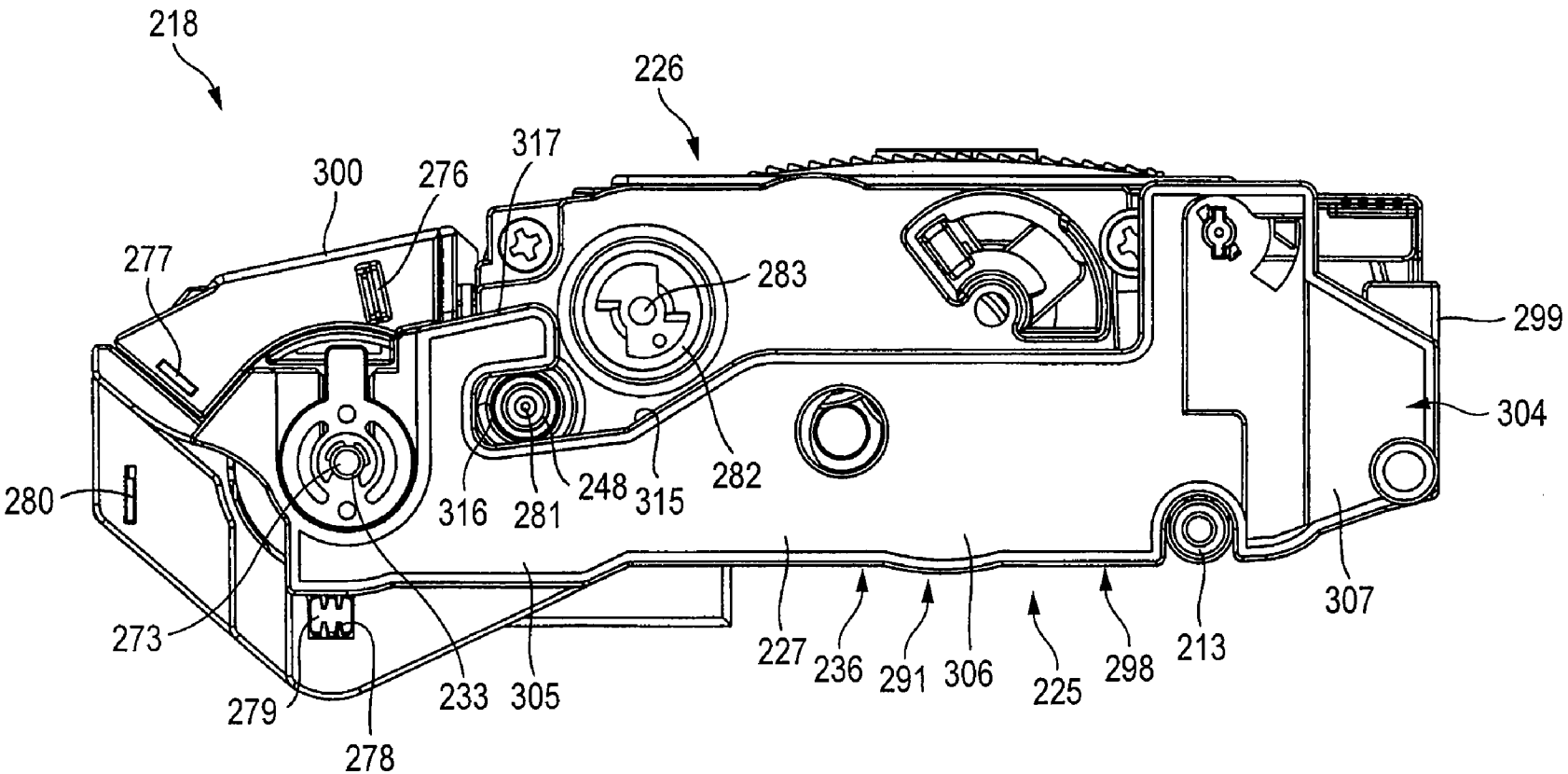
FIG. 13 is a left side view of a process cartridge shown in FIG. 7.

As shown in FIG. 13, the left end part of the drum shaft 233 protrudes from the left sidewall 296 of the drum cartridge 225, and the end face of the left end part is used as a drum ground electrode 273 on which a drum ground contact 366 to be described later abuts.

As shown in FIG. 12, the scorotron charger 229 is arranged within the drum accommodation portion 302. The scorotron charger 229 is supported by the charging support portions 322 at the oblique upper parts of the rear side of the photosensitive drum 228, and is arranged in opposition to the photosensitive drum 228 with a spacing so as not to touch the photosensitive drum. The scorotron charger 229 includes a wire 274 and a grid 275.

The wire 274 is extended between the left sidewall 296 and the right sidewall 297 inside the charging support portions 322. As shown in FIG. 13, a wire electrode 276 made of a sheet metal is attached to the left end part of the wire 274, and the wire electrode 276 is fixed so as to be exposed to the widthwise exterior from a slit which is formed in the up and down direction, at the upper front end part of the rear sidewall portion 205 of the left sidewall 296 (above the drum ground electrode 273).

As shown in FIG. 12, the grid 275 is arranged so as to surround the underside of the wire 274 along the widthwise direction, and it is extended between the left sidewall 296 and the right sidewall 297. As shown in FIG. 13, a grid electrode 277 which is made of a sheet metal is connected to the grid 275. Herein, at the rear end part of the rear sidewall portion 205 of the left sidewall 296 (obliquely above the rear side of the drum ground electrode 273), the grid electrode 277 is fixed so as to be exposed to the widthwise exterior from a slit which is formed in a direction inclining from the lower part of the front side of the rear sidewall portion 205 to the obliquely upper part of the rear side thereof.

The transfer roller 230 is arranged within the drum accommodation portion 302. The transfer roller 230 is rotatably supported between the left sidewall 296 and the right sidewall 297, lies in opposition to and touch with the photosensitive drum 228 from the lower side in the up and down direction, and forms a nip between the transfer roller and the photosensitive drum 228. The transfer roller 230 is configured in such a way that a metal-made transfer roller shaft 234 is covered with a roller 235 which is made of an electrically-conductive rubber material. As shown in FIG. 13, a transfer electrode hole 278 which is substantially rectangular is formed in the lower end part of the rear sidewall portion 205 of the left sidewall 296 (below the drum ground electrode 273), and a transfer electrode 279 is embedded in the transfer electrode hole 278 so as to be exposed to the widthwise exterior. The left end part of the transfer roller shaft 234 abuts on the transfer electrode 279.

As shown in FIG. 12, the cleaning brush 231 is arranged within the drum accommodation portion 302, and it is supported by the brush support portion 323 sideward of the rear side of the photosensitive drum 228. The cleaning brush 231 is such that a large number of brush bristles are planted in an elongate support plate being substantially rectangular, which extends in the widthwise direction. Herein, the cleaning brush 231 is arranged in opposition to the photosensitive drum 228 in the front and rear direction so that the brush bristles may touch the surface of the photosensitive drum 228 along the widthwise direction in a state where the cleaning brush is supported by the brush support portion 323. A cleaning electrode 280 which is made of a sheet metal is mounted at the left side end part of the support plate of the cleaning brush 231. As shown in FIG. 13, the cleaning electrode 280 is fixed so as to be exposed to the widthwise exterior from a slit which is formed in the up and down direction, at the rear end part of the rear sidewall portion 205 of the left sidewall 296 (in rear of the drum ground electrode 273).

The developing cartridge 226 is detachably attached to the developing-cartridge accommodation portion 303. As shown in FIGS. 7 and 8, the developing cartridge 226 includes a box-shaped housing 236 whose rear side is opened, a feed roller 237, and a developing roller 238 and a layer-thickness regulation blade 239 which serve as a developing unit. The members 37-39 are disposed in the housing 236.

Inside the housing 236, a partition plate 240 which protrudes downwards from the upper surface of the housing is provided extending in the widthwise direction, midway in the front and rear direction, and an internal space in front of the partition plate 240 is used as a toner accommodation chamber 241, while an internal space in rear of the partition plate 240 is used as a developing chamber 242.

In the toner accommodation chamber 241, a nonmagnetic single-component toner of positively-charging property is accommodated as a developing agent. Used as the toner is a polymerized toner which is obtained in such a way that polymerizable monomers, for example, a styrenic monomer such as styrene and an acrylic monomer such as acrylic acid, alkyl (C1-C4) acrylate or alkyl (C1-C4) methacrylate are copolymerized by a known polymerization method such as suspension polymerization. Such a polymerized toner is globular and exhibits a very good fluidity, and it can achieve image formation of high image quality.

A coloring agent such as carbon black and a wax are compounded in such a toner, and an additive such as silica is added in order to enhance the fluidity. The grain diameter of the toner is about 6-10 μm.

An agitator 243 for stirring the toner within the toner accommodation chamber 241 is disposed in the toner accommodation chamber 241. The agitator 243 is supported by an agitator rotating shaft 244 which extends in the widthwise direction at the central part of the toner accommodation chamber 241.

Within the developing chamber 242, the feed roller 237 is rotatably supported between both side plates which are arranged at front lower parts and which oppose in the widthwise direction of the housing 236. The feed roller 237 includes a feed roller shaft 246 which is made of a metal and which extends in the widthwise direction, and a sponge roller 247 which is made of an electrically-conductive foamed material and which covers the periphery of the feed roller shaft 246.

Within the developing chamber 242, the developing roller 238 is arranged at the rear lower part of the chamber, and it is disposed so that it may be held in pressed touch with the feed roller 237 and that its rear side portion may be partly exposed rearwards from the housing 236. The developing roller 238 includes a developing roller shaft 248 which is made of a metal, and a rubber roller 249 which is made of an electrically-conductive rubber material and which covers the periphery of the developing roller shaft 248. More specifically, the rubber roller 249 is made of electrically-conductive urethane rubber or silicone rubber containing carbon particles or the likes, and its surface is covered with fluorinated urethane rubber or silicone rubber. Incidentally, both the side shaft end parts of the developing roller shaft 248 are located so as to protrude from both the side plates of the housing 236 to the widthwise exterior, and the end face of the left side shaft end part is used as a developing roller electrode 281 which a developing roller contact 363 to be described later touches, as shown in FIG. 13.

The layer-thickness regulation blade 239 is made of a metallic leaf spring member, and it is provided at its distal end part with a pressing rubber member 250 of semicircular section which is made of insulating silicone rubber. The layer-thickness regulation blade 239 is supported by the housing 236 above the developing roller 238, and its lower end part opposes to the rubber roller 249 of the developing roller 238 from the front side, whereby the pressing rubber member 250 is brought into pressed touch with the surface of the rubber roller 249 by the elastic force of the layer-thickness regulation blade 239.

As shown in FIG. 13, the input gear 282 which serves to input mechanical driving forces to the agitator 243, feed roller 237 and developing roller 238 is arranged in the left side plate of the housing 236. The input gear 282 is formed in its central part with a joint hole 283 into which a coupling member 386 to be described later is relatively unrotatably joined. Herein, the input gear 282 is joined with the agitator rotating shaft 244, feed roller shaft 246 and developing roller shaft 248 through a gear transmission mechanism not shown, so as to be capable of transmitting the driving forces. When a driving force is input from the coupling member 386 to the input gear 282, the agitator 243, feed roller 237 and developing roller 238 are rotated on the basis of the driving force.

When the driving force is input from the coupling member 386 to the input gear 282 to rotate the agitator 243 with the agitator rotating shaft 244 as a fulcrum, the toner within the toner accommodation chamber 241 is stirred and is emitted from a toner emission port 245 underlying the partition plate 240, toward the developing chamber 242. The toner which is emitted into the developing chamber 242 by the rotation of the agitator 243 is fed onto the rubber roller 249 of the developing roller 238 by the rotation of the feed roller 237. On this occasion, the toner is frictionally charged into the positive polarity between the sponge roller 247 of the feed roller 237 and the rubber roller 249 of the developing roller 238. The toner fed onto the rubber roller 249 advances into the space between the rubber roller 249 and the pressing rubber member 250 of the layer-thickness blade 239 with the rotation of the developing roller 238, and it becomes a thin layer of predetermined thickness so as to be carried on the rubber roller 249.

The surface of the photosensitive drum 228 is positively charged uniformly by the scorotron charger 229 and is thereafter exposed to light by the high-speed scanning with the laser beam from the scanner portion 217, thereby to be formed with an electrostatic latent image based on the image data.

Subsequently, when the toner which is carried on the rubber roller 249 of the developing roller 238 and which is positively charged is brought into opposition to and touch with the photosensitive drum 228 by the rotation of the developing roller 238, it is fed to the electrostatic latent image which is formed on the surface of the photosensitive drum 228, that is, the exposed part which has been exposed to the light by the laser beam and whose electric potential is lower, in the surface of the photosensitive drum 228 positively charged uniformly, and it is selectively carried, thereby to be turned into a visible image. Thus, the toner image is formed by reversal developing.

Thereafter, the photosensitive drum 228 and the transfer roller 230 are driven and rotated so as to interpose therebetween and convey the sheet of paper 203 conveyed from the conveyance path 90, and the sheet of paper 203 is conveyed between the photosensitive drum 228 and the transfer roller 230, whereby the toner image carried on the surface of the photosensitive drum 228 is transferred onto the sheet of paper 203.

After the transfer, paper powder which has adhered to the surface of the photosensitive drum 228 due to the touch of the photosensitive drum with the sheet of paper 203 is removed by the brush of the cleaning brush 231 when the surface of the photosensitive drum 228 has opposed to the cleaning brush 231 with the rotation of the photosensitive drum 228.

The fixation portion 219 is disposed on the rear side of the process cartridge 218, and it includes a fixation frame 251 which extends in the widthwise direction, and a heating roller 252 and a pressing roller 253 which are rotatably supported by the frame 251 and which are arranged in opposition in the up and down direction.

The heating roller 252 includes a metallic elementary pipe 193, and a heating halogen lamp 194 disposed in the metallic elementary pipe 193, and it is driven to rotate by the input of power from a motor not shown.

The pressing roller 253 is arranged under the heating roller 252 and in opposition thereto so as to press the heating roller 252. The pressing roller 253 is configured in such a way that a metal-made roller shaft 254 is covered with a roller 255 made of a rubber material, and it is driven in accordance with the rotating drive of the heating roller 252.

In the fixation portion 219, the toner transferred on the sheet of paper 203 is thermally fixed while the sheet of paper 203 passes through the space between the heating roller 252 and the pressing roller 253. The sheet of paper 203 on which the toner has been fixed is conveyed to a paper ejection path 256 that extends in the up and down direction toward the upper surface of the body casing 202. The sheet of paper 203 conveyed to the paper ejection path 256 is delivered onto a paper ejection tray 258 formed on the upper surface of the body casing 202, by paper ejection rollers 257 which are disposed at the upper end of the paper ejection path.

Figure 14:
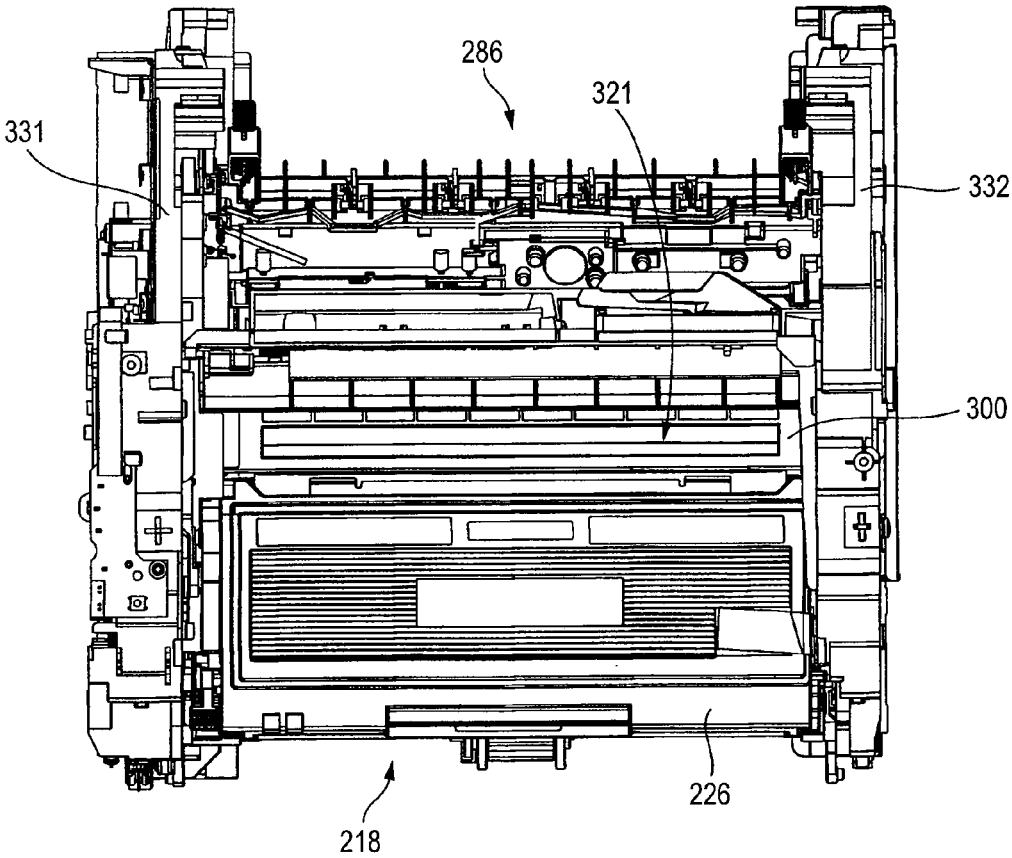
FIG. 14 is a plan view of the process cartridge, a left frame and a right frame shown in FIG. 7.

FIG. 14 is a plan view showing the internal configuration of the laser printer 201. A left frame 331 being a first sidewall and a right frame 332 being a second sidewall, which are made of a resin and which are arranged in opposition in the widthwise direction, are disposed in the body casing 202. The guide plate 286 is extended between the left frame 331 and the right frame 332, and the process cartridge 218 is attached over the guide plate 286.

Figure 15:
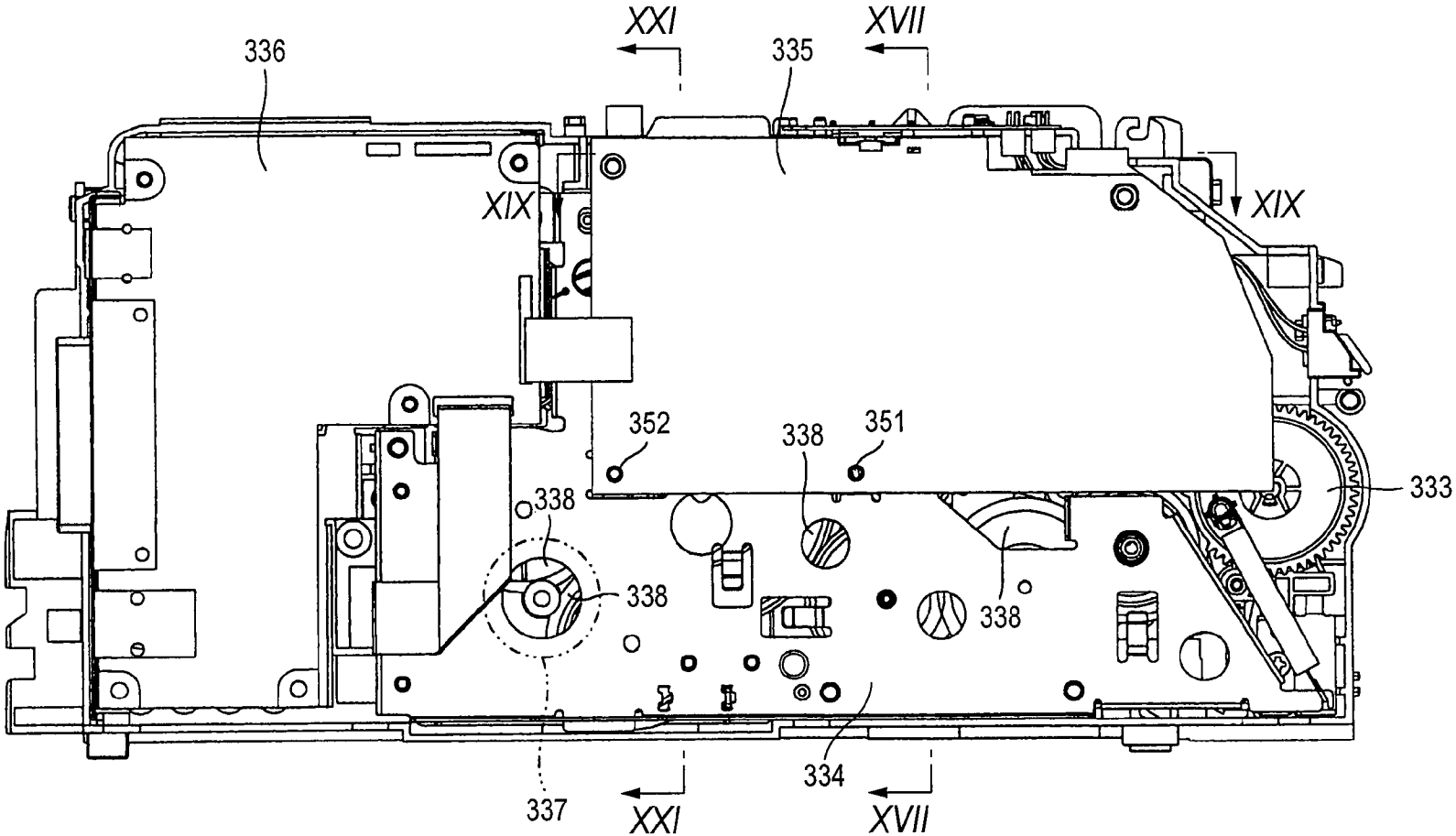
FIG. 15 is an outer side view of the left frame shown in FIG. 14.

As shown in FIG. 15, the left frame 331 is substantially in an oblong shape which extends in the front and rear direction as viewed in side elevation. A plurality of input gears, such as a paper feed roller gear 333, to which driving forces are input from transmission gears 338 to be described below, are supported by the outer side surface of the left frame 331. A gear plate 334, a high-voltage circuit board 335 and a main circuit board 336 are arranged on the outer side surface of the left frame 331.

The gear plate 334 is made of a sheet metal, and is arranged so as to extend from the front end edge of the left frame 331, rearwards and along the lower end edge of the outer side surface of the left frame 331. Supported by the surface of the gear plate 334 opposite the left frame 331 are a motor 337 which is a driving source, and the transmission gears 338 being a plurality of first gears, which serve to transmit the driving forces based on the motor 337, to the photosensitive drum 228, paper feed tray 208 (lever 215), and paper feed roller 209.

The high-voltage circuit board 335 is a power-source circuit board which boosts the voltage of single phase and 100 V fed from the exterior of the laser printer 201, so as to generate high-voltage biases which are respectively applied to the scorotron charger 229, transfer roller 230, cleaning brush 231 and developing roller 238. The high-voltage circuit board 335 is formed substantially in an oblong shape as viewed in side elevation, and is arranged in opposition to the gear plate 334 from a widthwise outer side so that the lower end part of the circuit board may overlap the upper end part of the gear plate 334, in the widthwise direction (the direction of the opposition between the left frame 331 and the right frame 332).

Figure 16:
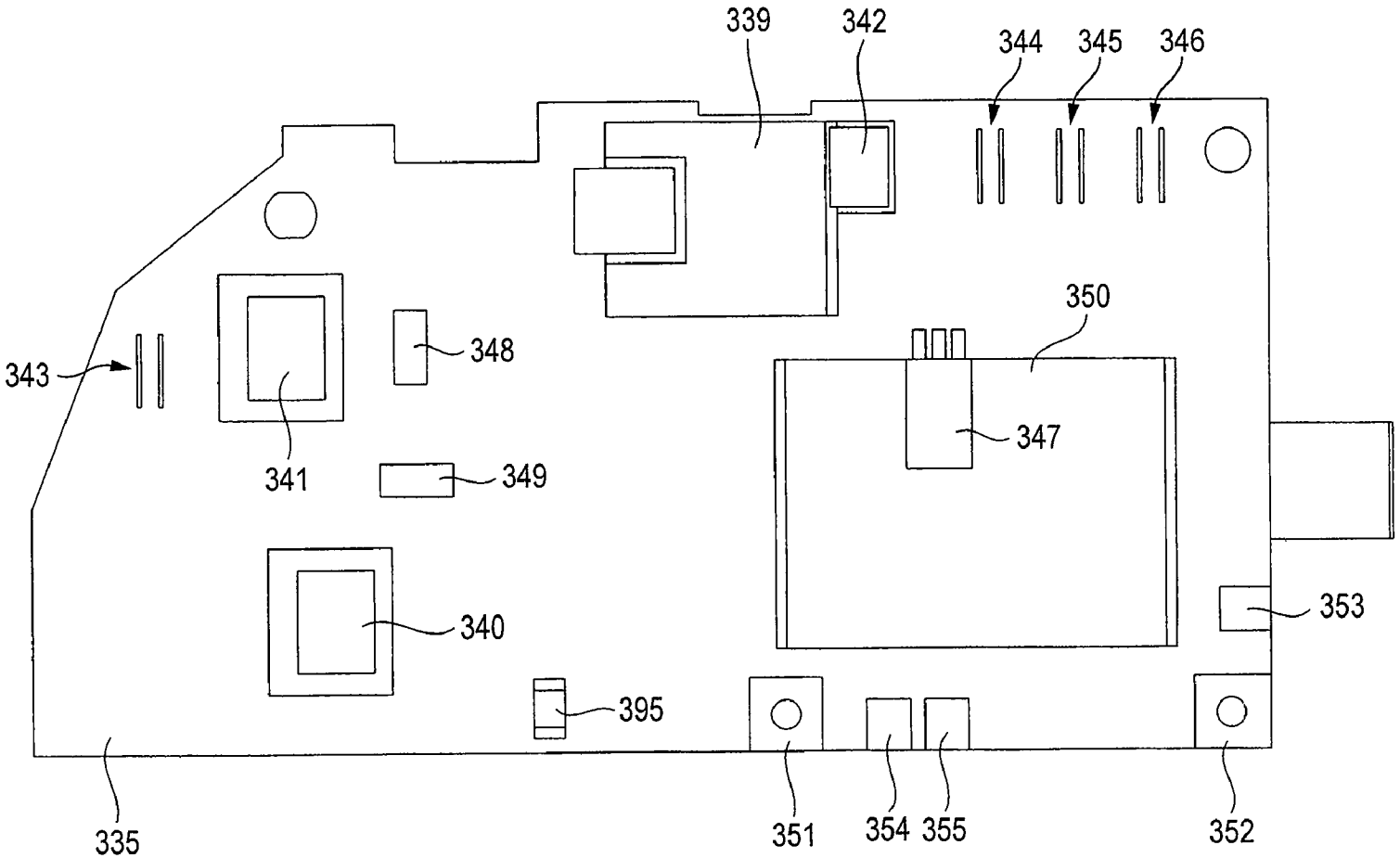
FIG. 16 is a view showing the configuration of a high-voltage circuit board shown in FIG. 15.

As shown in FIG. 16, on the surface of the high-voltage circuit board 335 opposite the left frame 331, there are mounted a charging transformer 339 being a transformer which serves to generate an electric discharge bias for the wire 274 of the scorotron charger 229, a transferring transformer 340 being a transformer which serves to generate a transfer bias for the transfer roller 230, a developing transformer 341 being a transformer which serves to generate a developing bias for the developing roller 238, an electric-discharge bias output terminal 342 being a supply-voltage output terminal which serves to output the electric discharge bias, a transfer bias output terminal 343 being another bias output terminal which is a supply-voltage output terminal for outputting the transfer bias, a developing-bias output terminal 344 being a third bias output terminal or another bias output terminal which is a supply-voltage output terminal for outputting the developing bias, a grid bias output terminal 345 being a third bias output terminal or another bias output terminal which is a supply-voltage output terminal for outputting a grid bias for the grid 275 of the scorotron charger 229, a cleaning bias output terminal 346 being a third bias output terminal or another bias output terminal which is a supply-voltage output terminal for outputting a cleaning bias for the cleaning brush 231, transistors 347, 348 and 349 which serve to change-over the outputs and stops of the biases from the respective bias output terminals 342-346, a heat radiation plate 350 which serves to prevent the transistor 347 from being thermally broken down, ground connection terminals 351 and 352 which serve to perform ground connections, connectors 353, 354 and 355 which serve to perform electrical connections with the exterior, and an optical sensor 395 which serves to detect the position of a detector constituting a post-registration sensor not shown (a sensor which senses the arrival of the sheet of paper 203 in order to control the emission timing of the laser beam from the scanner portion 217).

The charging transformer 339, transferring transformer 340, developing transformer 341 and transistors 348 and 349 are arranged in regions which do not overlap the gear plate 334 in the widthwise direction, in the surface of the high-voltage circuit board 335 opposite the left frame 331, while the transistor 347, ground connection terminals 351 and 352, connectors 353, 354 and 355 and sensor 395 are arranged in regions which overlap the gear plate 334 in the widthwise direction, in the surface of the high-voltage circuit board 335 opposite the left frame 331. That is, among the components which are mounted on the surface of the high-voltage circuit board 335 opposite the left frame 331, those which are comparatively tall are arranged in the regions of the opposing surface as do not overlap the gear plate 334 in the widthwise direction, and those which are comparatively low are arranged in the regions of the opposing surface as overlap the gear plate 334 in the widthwise direction.

The electric-discharge bias output terminal 342, transfer bias output terminal 343, developing bias output terminal 344, grid bias output terminal 345 and cleaning bias output terminal 346 are arranged in regions which do not overlap the gear plate 334 in the widthwise direction, in the surface of the high-voltage circuit board 335 opposite the left frame 331.

More specifically, in the surface of the high-voltage circuit board 335 opposite the left frame 331, the charging transformer 339 is arranged at the upper end part and the intermediate part in the front and rear direction as do not overlap the gear plate 334 in the widthwise direction, and in rear of the charging transformer 339, the developing bias output terminal 344, grid bias output terminal 345 and cleaning bias output terminal 346 are arranged in juxtaposition and in the order from the front side. The electric-discharge bias output terminal 342 is arranged in rear of the charging transformer 339. The transferring transformer 340 is arranged at the upper end part of the front side as does not overlap the gear plate 334 in the widthwise direction, and the developing transformer 341 is arranged at the lower end part of the front side (below the transferring transformer 340) as does not overlap the gear plate 334 in the widthwise direction. Besides, the transfer bias output terminal 343 is arranged in front of the developing transformer 341, while the transistors 348 and 349 are arranged in vertical opposition in rear of the developing transformer 341. Further, the heat radiation plate 350 is arranged at the lower end part of the rear side as overlaps the gear plate 334 in the widthwise direction, and the transistor 347 is arranged on the upper part of the heat radiation plate 350. Still further, the ground connection terminal 351 and the connectors 354 and 355 are juxtaposed along the lower end edge of the high-voltage circuit board 335 under the heat radiation plate 350, and the ground connection terminal 352 is arranged at the rear lower corner of the high-voltage circuit board 335. The connector 353 is arranged over the ground connection terminal 352.

Figure 17:
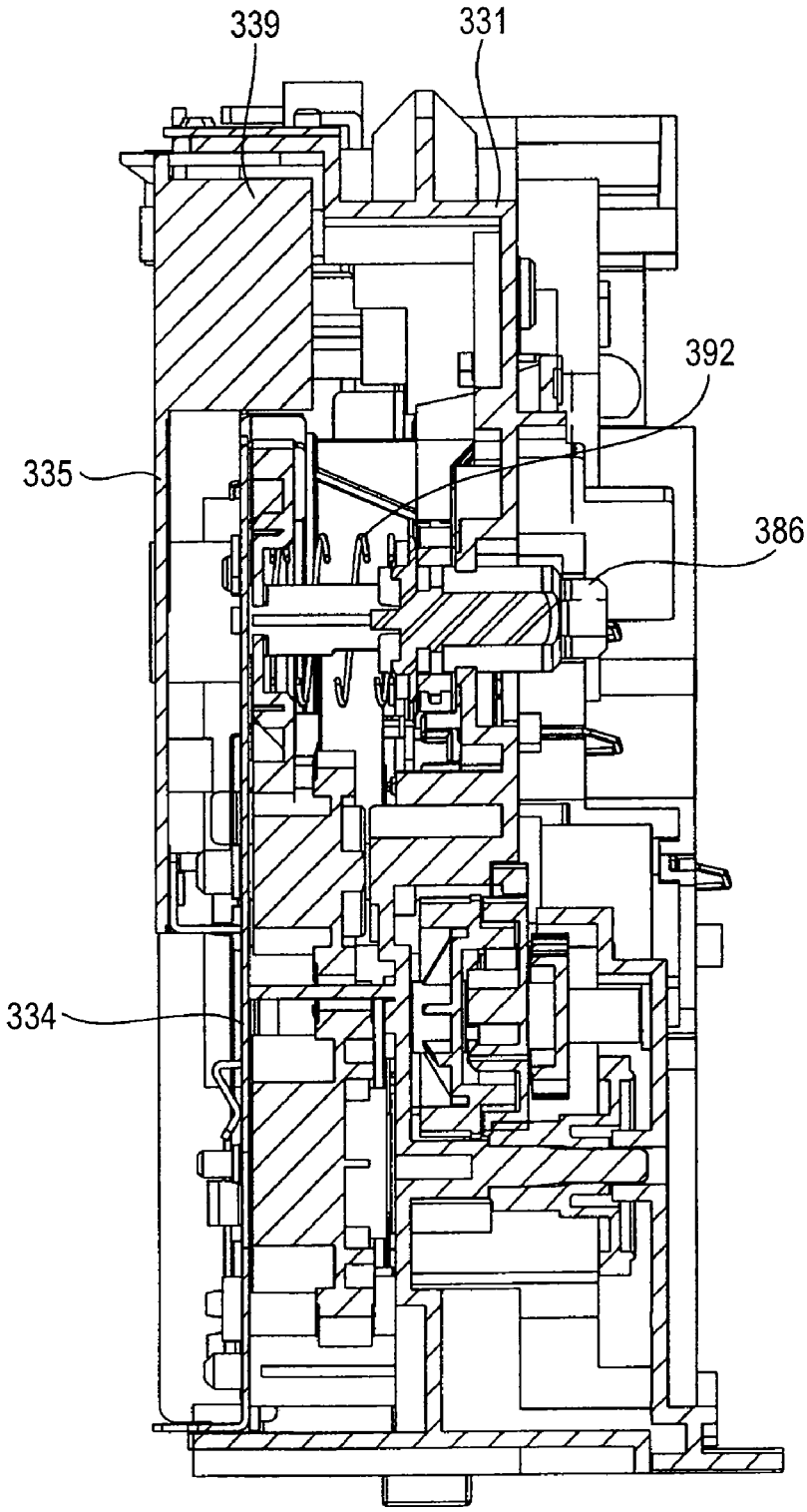
FIG. 17 is a sectional view taken along cutting line XVII-XVII indicated in FIG. 15.

According to such arrangements, among the components which are mounted on the surface of the high-voltage circuit board 335 opposite the left frame 331, the comparatively tall components including the charging transformer 339 are arranged in the regions of the opposing surface as do not overlap the gear plate 334 in the widthwise direction, whereby these comparatively tall components are arranged so as to overlap the gear plate 334 in the up and down direction or in the front and rear direction as shown in FIG. 17.

The distance between the electric-discharge bias output terminal 342 and the transfer bias output terminal 343 is held longer than the respective distances between the electric-discharge bias output terminal 342 and the developing bias output terminal 344, grid bias output terminal 345 and cleaning bias output terminal 346, whereby the distance at which no leakage occurs is ensured between the electric-discharge bias output terminal 342 and the transfer bias output terminal 343.

Figure 18:
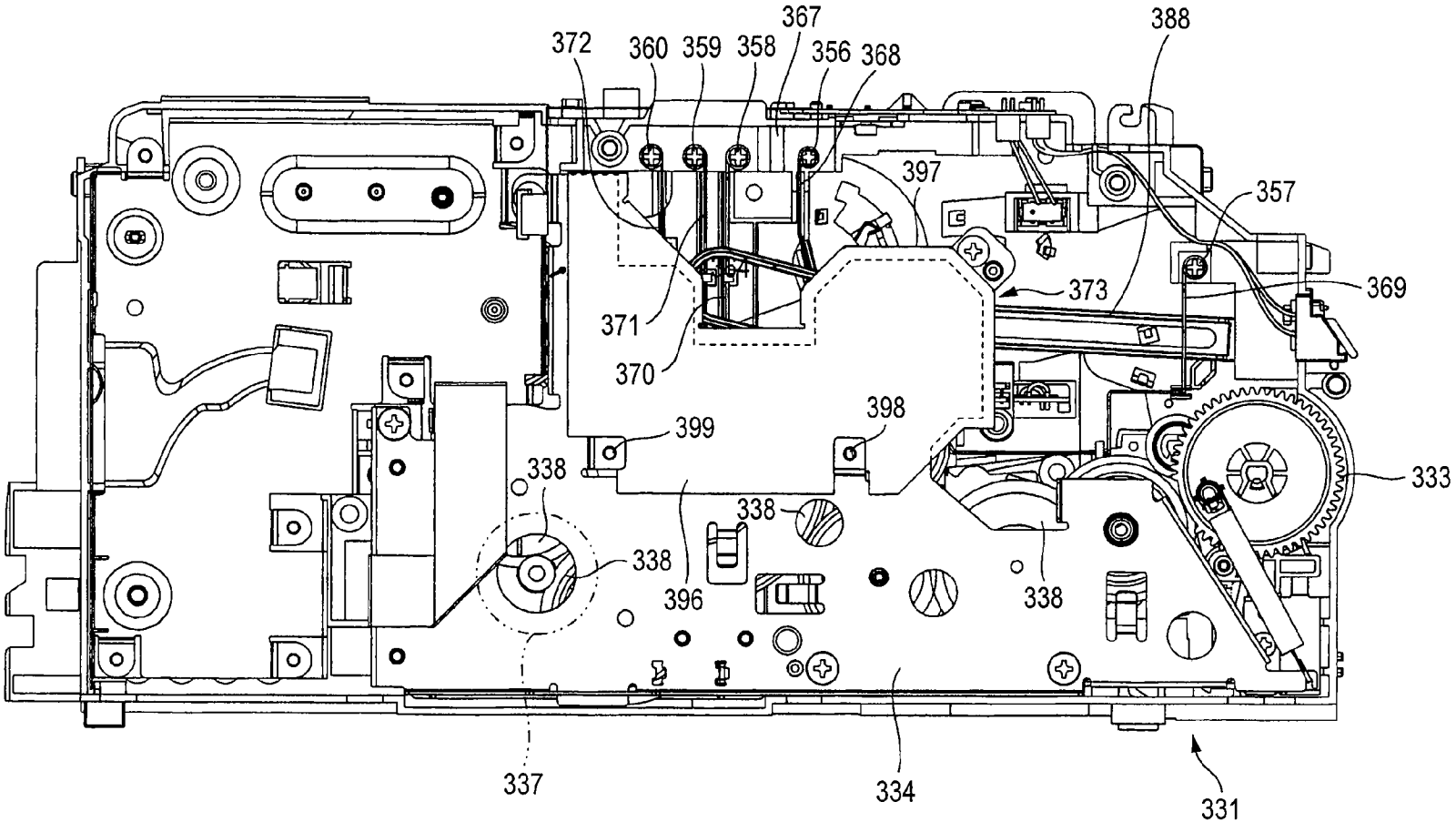
FIG. 18 is an outer side view of the left frame in a state where the high-voltage circuit board shown in FIG. 15 has been detached.

As shown in FIG. 18, on the outer side surface of the left frame 331, spring-shaped connection members 356, 358, 359 and 360 which are respectively configured by winding wire pieces are disposed in a state where they protrude toward the widthwise outer side, at the intermediate part of the upper end edge of the outer side surface in the front and rear direction, and at positions to which the electric-discharge bias output terminal 342, developing bias output terminal 344, grid bias output terminal 345 and cleaning bias output terminal 346 oppose in the widthwise direction, respectively. Near the front upper end part of the outer side surface of the left frame 331, a spring-shaped connection member 357 which is configured by winding a wire piece is disposed in a state where it protrudes toward the widthwise outer side, at a position which opposes to the transfer bias output terminal 343 in the widthwise direction.

Between the connection member 356 to which the electric-discharge bias output terminal 342 opposes and the connection member 358 to which the developing bias output terminal 344 opposes, a rib 367 being a shield member which serves to prevent leakage from occurring therebetween is formed protruding from the outer side surface of the left frame 331.

Figure 19:
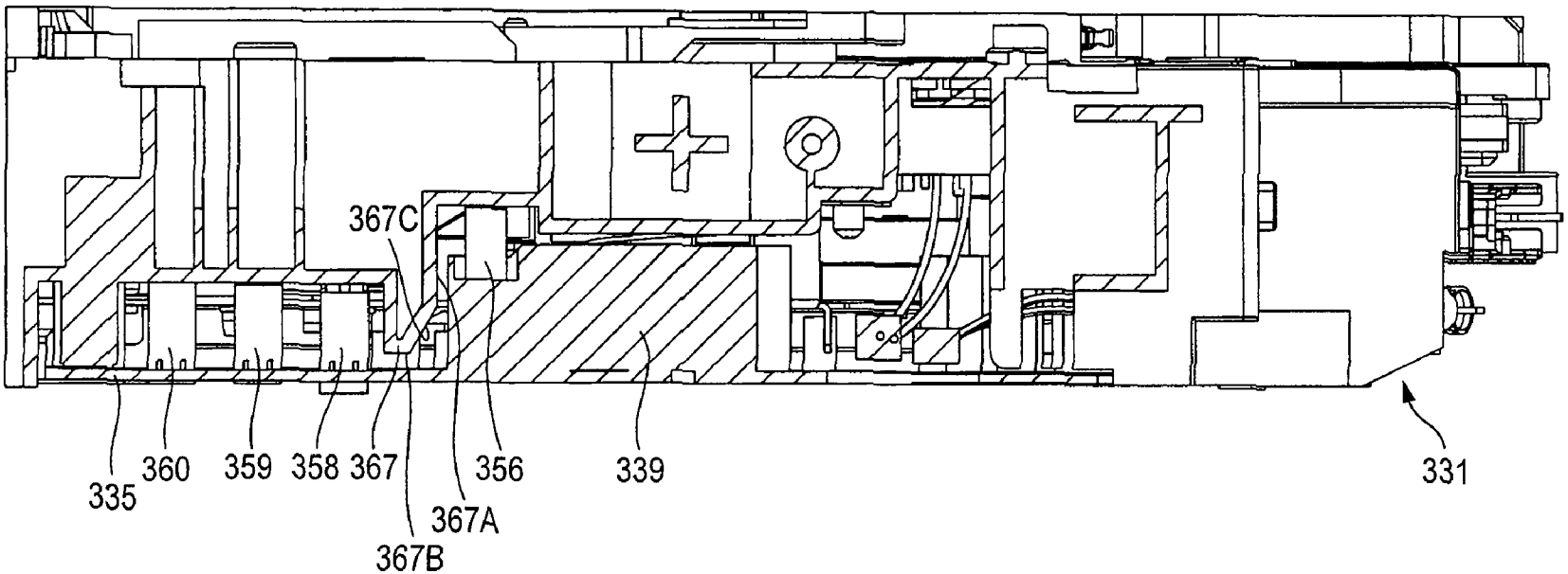
FIG. 19 is a sectional view taken along cutting line XIX-XIX indicated in FIG. 15.

The rib 367 is arranged at a position at which it comes into sliding friction with the rear end face of the charging transformer 339 where the electric-discharge bias output terminal 342 is located. As shown in FIG. 19, the rib 367 is formed with a slant surface 367C which inclines frontward toward the widthwise outer side, between a front end face 367A and a surface 367B opposite the high-voltage circuit board 335. Herein, when the high-voltage circuit board 335 is to be attached to the outer side surface of the left frame 331, the charging transformer 339 is guided onto the front side of the rib 367 by the slat surface 367C of the rib 367. While the rear end face of the charging transformer 339 is held in sliding friction with the front end face 367A of the rib 367, the high-voltage circuit board 335 is brought near to the outer side surface of the left frame 331. Then, the electric-discharge bias output terminal 342 is reliably brought into abutment against the connection member 356. That is, the rib 367 serves also as guide unit for guiding the electric-discharge bias output terminal 342 so as to abut against the connection member 356.

While the charging transformer 339 is held in sliding friction with the front end face of the rib 367, the high-voltage circuit board 335 is attached to the outer side surface of the left frame 331, whereby the electric-discharge bias output terminal 342, transfer bias output terminal 343, developing bias output terminal 344, grid bias output terminal 345 and cleaning bias output terminal 346 are brought into elastic abutment against the connection members 356, 357, 358, 359 and 360 in the widthwise direction, respectively.

The high-voltage circuit board 335 is arranged so as to overlap the gear plate 334, and screws not shown are threadably engaged with tapped holes 398 and 399 formed in the gear plate 334, through the respective ground connection terminals 351 and 352, whereby the high-voltage circuit board 335 is fixed to the gear plate 334, and it is electrically connected to the gear plate 334 and is grounded through the gear plate 334.

Figure 20:
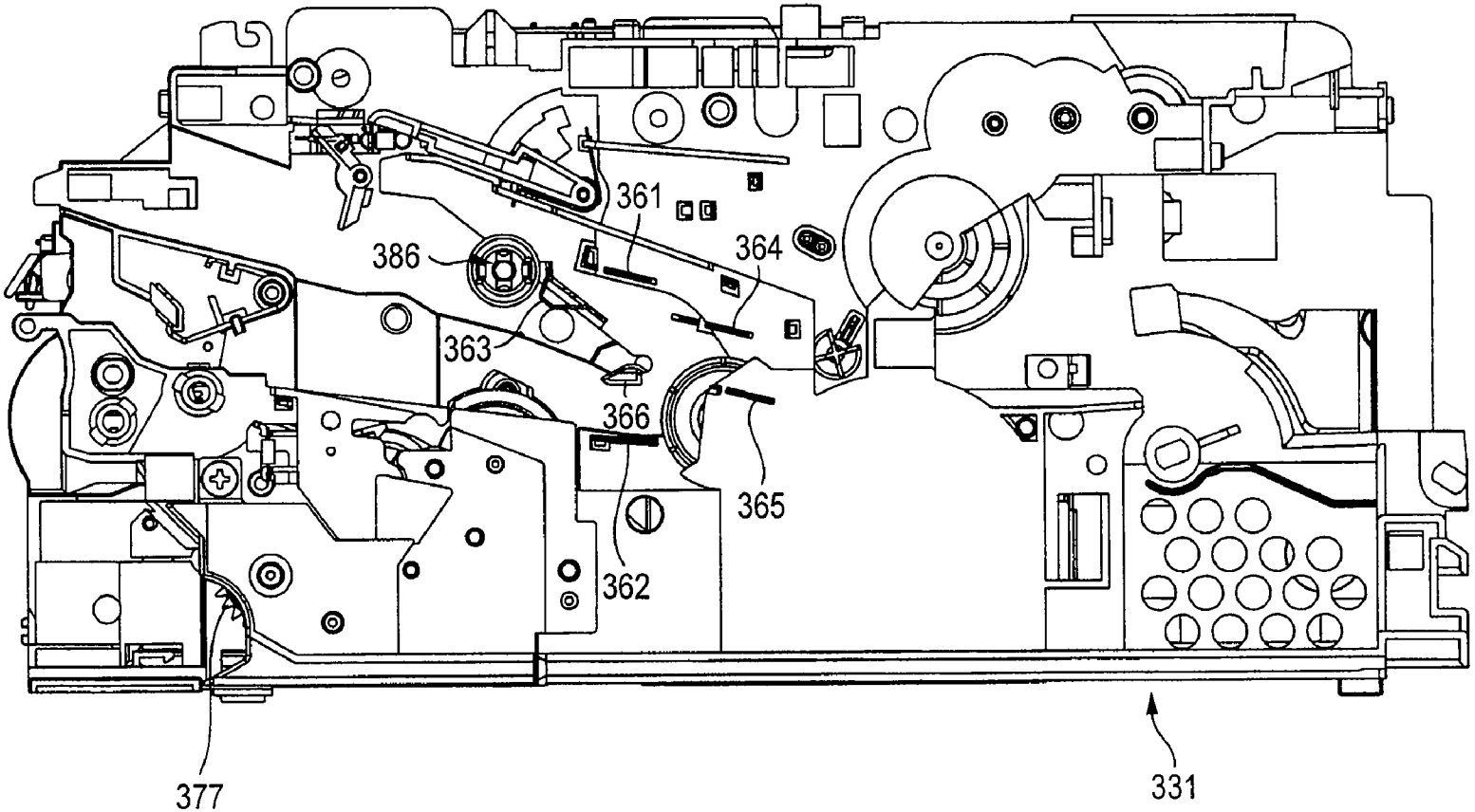
FIG. 20 is an inner side view of the left frame shown in FIG. 14.

Meanwhile, as shown in FIG. 20, a wire contact 361, a transfer contact 362, a developing roller contact 363, a grid contact 364 and a cleaning contact 365 are disposed on the inner side surface of the left frame 331. These contacts are formed at positions which respectively oppose to the wire electrode 276, transfer electrode 279, developing roller electrode 281, grid electrode 277 and cleaning electrode 280 arranged on the left side surface of the process cartridge 218, when the process cartridge 218 has been attached to the body casing 202, and they are contacts which respectively abut against these electrodes.

The wire contact 361 is connected to the connection member 356 opposite the electric-discharge bias output terminal 342, through a wiring line 368 (refer to FIG. 18) being a conductor for the electric discharge bias. Thus, in the state where the process cartridge 218 has been attached to the body casing 202, the electric-discharge bias output terminal 342 of the high-voltage circuit board 335 and the wire electrode 276 of the process cartridge 218 are electrically connected through the connection member 356, wiring line 368 and wire contact 361, while bypassing the gear plate 334, and the electric discharge bias which is output from the electric-discharge bias output terminal 342 is applied to the wire 274 of the scorotron charger 229.

The transfer contact 362 is connected to the connection member 357 opposite the transfer bias output terminal 343, through a wiring line 369 (refer to FIG. 18) being another conductor for the bias. Thus, in the state where the process cartridge 218 has been attached to the body casing 202, the transfer bias output terminal 343 of the high-voltage circuit board 335 and the transfer electrode 279 of the process cartridge 218 are electrically connected through the connection member 367, wiring line 369 and transfer contact 362, while bypassing the gear plate 334, and the transfer bias which is output from the transfer bias output terminal 343 is applied to the transfer roller 230.

The developing roller contact 363 is connected to the connection member 358 opposite the developing bias output terminal 344, through a wiring line 370 (refer to FIG. 18) being another conductor for the bias. Thus, in the state where the process cartridge 218 has been attached to the body casing 202, the developing bias output terminal 344 of the high-voltage circuit board 335 and the developing roller electrode 281 of the process cartridge 218 are electrically connected through the connection member 358, wiring line 370 and developing roller contact 363, while bypassing the gear plate 334, and the developing bias which is output from the developing bias output terminal 344 is applied to the developing roller 238.

Figure 21:
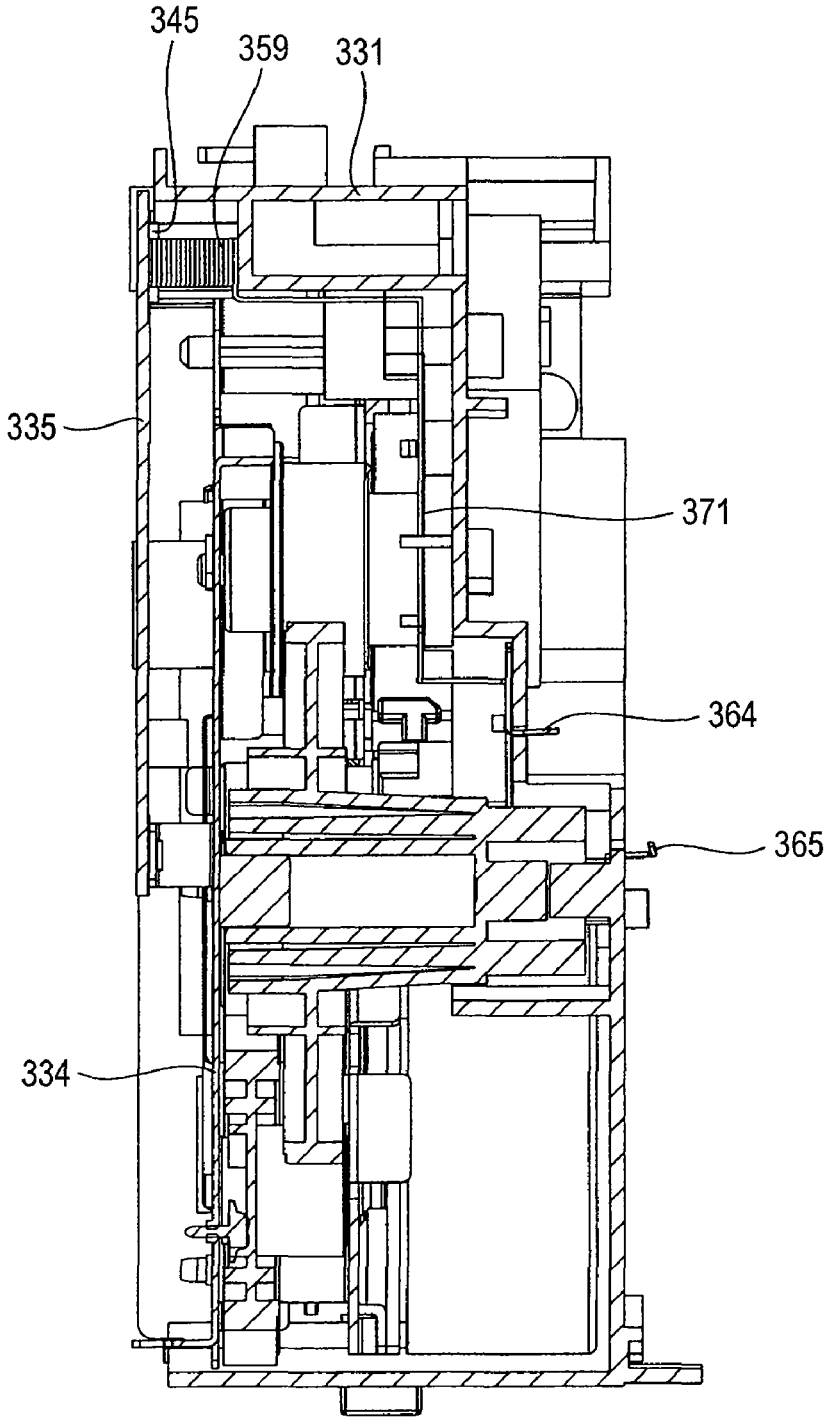
FIG. 21 is a sectional view taken along cutting line XXI-XXI indicated in FIG. 15.

The grid contact 364 is connected to the connection member 359 opposite the grid bias output terminal 345, through a wiring line 371 (refer to FIG. 18) being another conductor for the bias. Thus, in the state where the process cartridge 218 has been attached to the body casing 202, and as shown in FIG. 21, the grid bias output terminal 345 of the high-voltage circuit board 335 and the grid electrode 277 of the process cartridge 218 are electrically connected through the connection member 359, wiring line 371 and grid contact 364, while bypassing the gear plate 334, and the grid bias which is output from the grid bias output terminal 345 is applied to the grid 275 of the scorotron charger 229.

The cleaning contact 365 is connected to the connection member 360 opposite the cleaning bias output terminal 346, through a wiring line 372 (refer to FIG. 18) being another conductor for the bias. Thus, in the state where the process cartridge 218 has been attached to the body casing 202, the cleaning bias output terminal 346 of the high-voltage circuit board 335 and the cleaning electrode 280 of the process cartridge 218 are electrically connected through the connection member 360, wiring line 372 and cleaning contact 365, while bypassing the gear plate 334, and the cleaning bias which is output from the cleaning bias output terminal 346 is applied to the cleaning brush 231.

Further, as shown in FIG. 20, a drum ground contact 366 is disposed on the inner side surface of the left frame 331. The drum ground contact 366 is arranged at a position which opposes to the drum ground electrode 273 arranged on the left side surface of the process cartridge 218 and at which the drum ground electrode 273 abuts against the drum ground contact, when the process cartridge 218 has been attached to the body casing 202. The drum ground contact 366 is electrically connected with the gear plate 334, and is grounded through the gear plate 334. Thus, when the drum ground electrode 273 disposed on the left side surface of the process cartridge 218 has brought into abutment on the drum ground contact 366 by the attachment of the process cartridge 218 to the body casing 202, the drum shaft 233 of the photosensitive drum 228 is grounded through the drum ground electrode 273, drum ground contact 366 and gear plate 334.

Part of the lever-driving-force transmission gear 377 that serves as a second gear which is rotatably supported by the left frame 331 is exposed to the inner side surface of the left frame 331 and at the lower end part of the front side thereof.

When the paper feed tray 208 (refer to FIG. 7) is mounted in the body casing 202, the input gear 267 is meshed with the lever-driving-force transmission gear 377. When the lever transmission gear 377 is rotated clockwise in FIG. 9 (counterclockwise as viewed in FIG. 20) by the driving force of the motor 337 (refer to FIG. 15), the input gear 267 is rotated counterclockwise, and the lever driving gear 268 is rotated clockwise, so that the front end part of the paper presser plate 214 is lifted up by the lever 215 as described above. On this occasion, the lever-driving-force transmission gear 377 is driven to rotate counterclockwise in FIG. 20, and it endows the input gear 267 with a force urging the paper feed tray 208 in the mounting direction thereof, whereby the paper feed tray 208 has its dismounting from the body casing 202 regulated by the cooperation between the lever-driving-force transmission gear 377 and the tray lock piece 279 to be described later.

As shown in FIG. 18, that upper end part of the gear plate 334 which opposes to the connection members 356, 358, 359 and 360 in the up and down direction and which overlaps the high-voltage circuit board 335 in the widthwise direction (the opposing direction between the left frame 331 and the right frame 332) is covered with an insulating sheet 373 which serves to prevent leakages from occurring between the high-voltage circuit board 335 (electric-discharge bias output terminal 342, transfer bias output terminal 343, developing bias output terminal 344, grid bias output terminal 345 and cleaning bias output terminal 346) and the gear plate 334.

The insulating sheet 373 is made of a translucent resin material, and is formed in a shape corresponding to the contour of the upper end part of the gear plate 334. The insulating sheet 373 includes an opposing surface part 396 which is arranged so as to oppose to the gear plate 334 in the widthwise direction, and an edge part 397 which is bent and extended in its direction opposite the gear plate 334, from the upper end edge and front end edge of the opposing surface part 396. The gear plate 334 and the high-voltage circuit board 335 are electrically insulated by the opposing surface part 396, and the gear plate 334 and the connection members 356, 357, 358, 359 and 360 are electrically insulated by the edge part 397.

The main circuit board 336 is a control circuit board which includes a CPU for controlling the operations of the various portions of the laser printer 201, and so on. As shown in FIG. 15, the main circuit board 336 is formed substantially in L-lettered shape as viewed side elevation, and it is arranged in a space which is formed on the rear side of the gear plate 334 as well as the high-voltage circuit board 335, in the outer side surface of the left frame 331, so that the main circuit board may not overlap the gear plate 334 or the high-voltage circuit board 335.

Figure 22:
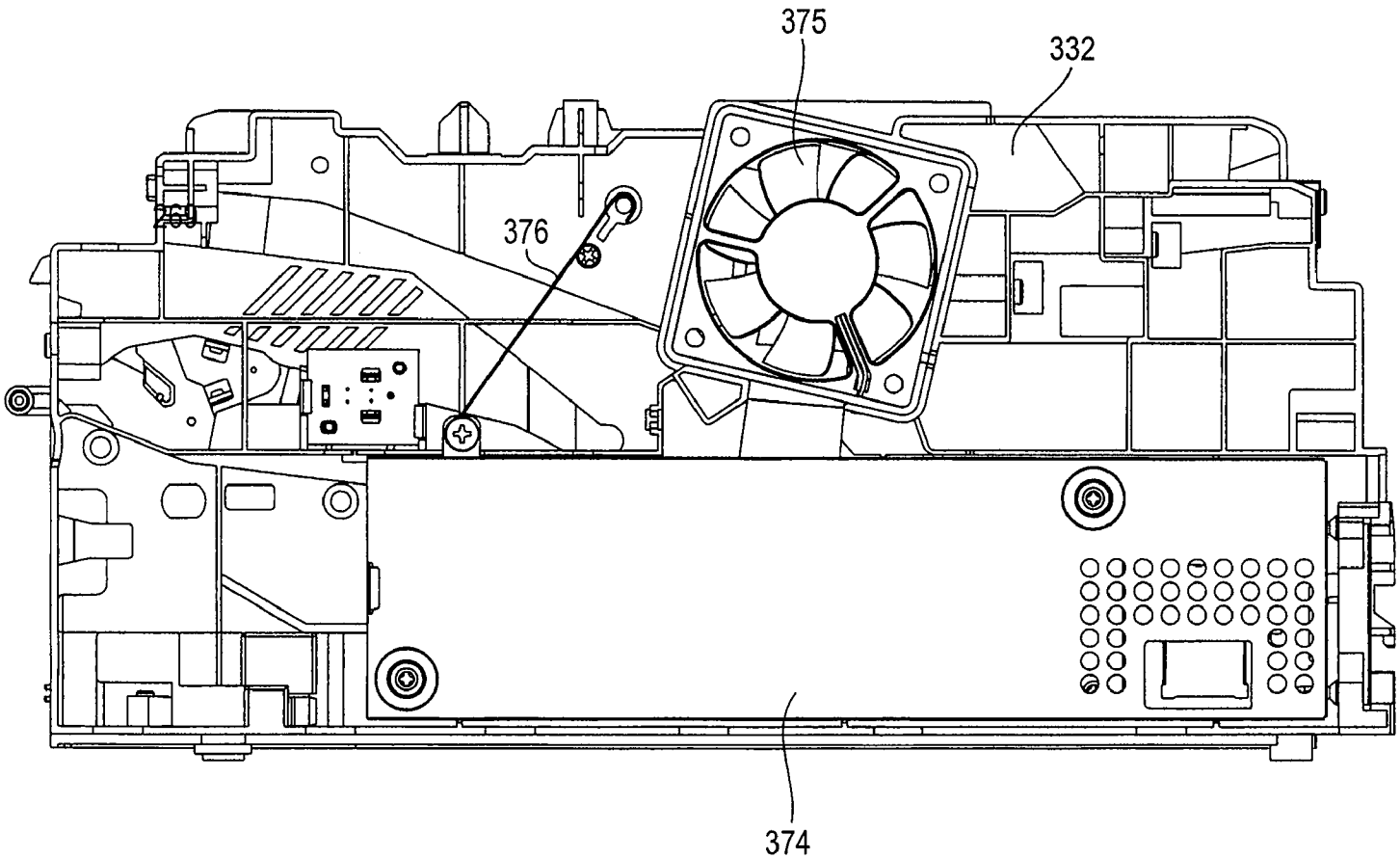
FIG. 22 is an outer side view of the right frame shown in FIG. 14.

As shown in FIG. 22, the right frame 332 forms a substantially oblong shape extending in the front and rear direction as viewed in side elevation, and a low-voltage circuit board 374 and a fan 375 are arranged on the outer side surface of the right frame.

The low-voltage circuit board 374 is a power-source circuit board for stepping down the voltage of single phase and 100 V fed from the exterior of the laser printer 201, so as to generate low voltages for driving the motor 337 (refer to FIG. 15). The low-voltage circuit board 374 is arranged so that the surface of the circuit board on which transformers etc. are mounted may face the outer side surface of the right frame 332, and that the circuit board may extend frontward from the rear end edge of the right frame 332 along the lower end edge thereof. Besides, the low-voltage circuit board 374 is grounded (ground-connected) to the right frame 332 through a ground line 376.

The fan 375 serves to emit generated heat from the process cartridge 218 and the fixation portion 219, out of the body casing 202, and is arranged so as to bring the widthwise inner side and widthwise outer side of the right frame 332 into communication, over the low-voltage circuit board 374.

Figure 23:
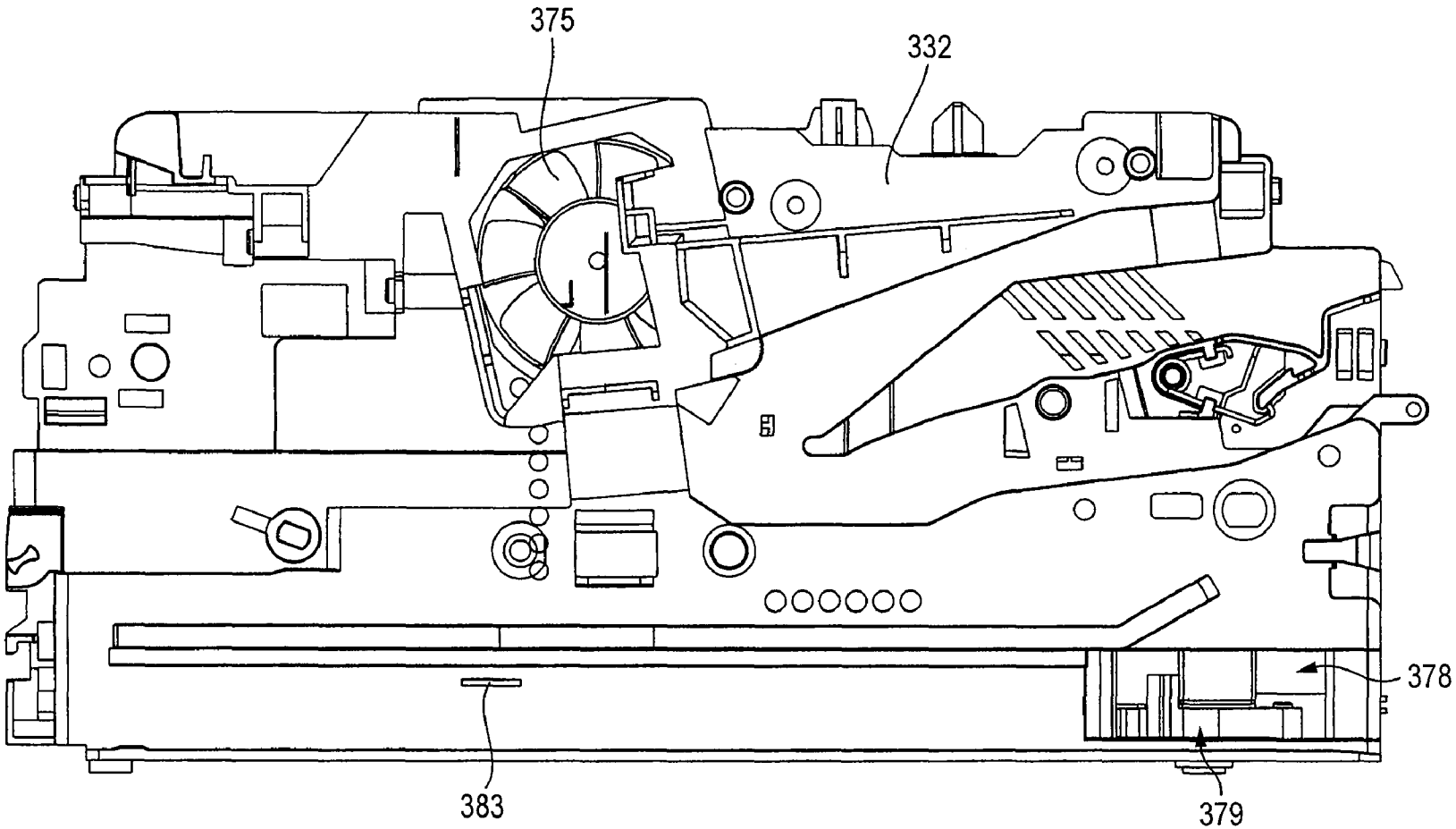
FIG. 23 is an inner side view of the right frame shown in FIG. 14.

As shown in FIG. 23, a recess 378 which is concave toward the widthwise outer side is formed in the inner side surface of the right frame 332 and in the lower end part of the front side thereof. The tray lock piece 279 being a lock mechanism which serves to prevent the paper feed tray 208 (refer to FIG. 7) from being dismounted, is included in the recess 378.

Figure 24:
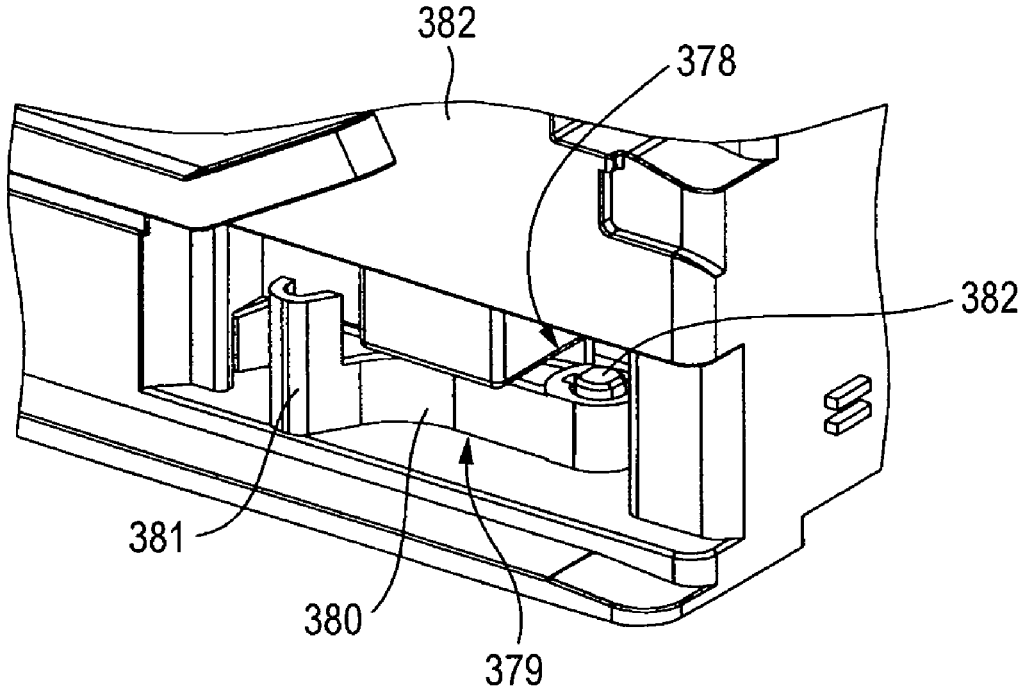
FIG. 24 is a perspective view of essential portions showing the configuration of a tray lock piece shown in FIG. 22.

As shown in FIG. 24, the tray lock piece 279 includes a curved arm 380 which extends in the front and rear direction and whose distal part is curved so as to proceed out of the recess 378, and an abutment portion 381 which is joined to the distal end part of the curved arm 380, which extends in the up and down direction and whose section is substantially in U-lettered shape. The base end part of the curved arm 380 is swingably mounted on a shaft 382 extending in the up and down direction, within the recess 378. A spring not shown is connected to the curved arm 380, and the abutment portion 381 is normally urged elastically in the direction of protruding out of the recess 378, by the spring.

When the paper feed tray 208 is to be mounted in the body casing 202, the lock-piece engagement portion 271 disposed in the paper feed tray 208 abuts on the abutment portion 381 of the tray lock piece 279, and the tray lock piece 279 is pressed in the direction of withdrawing the abutment portion 381 into the recess 378 against the urging force of the spring not shown, with the movement of the lock-piece engagement portion 271. When the lock-piece engagement portion 271 has gotten over the abutment portion 381, the tray lock piece 279 is restored into the direction of protruding the abutment portion 381 out of the recess 378, by the urging force of the spring not shown, and the abutment portion 381 is brought into engagement from the front side of the lock-piece engagement portion 271. Thus, the paper feed tray 208 can be prevented from being undesirably dismounted from the body casing 202.

As shown in FIG. 23, the inner side surface of the right frame 332 is protrusively provided with the presser-plate ground contact 383 being a ground contact which is fitted into the ground connection hole 272 (refer to FIG. 11) formed in the paper feed tray 208, when the paper feed tray 208 has been mounted in the body casing 202.

Figure 25:
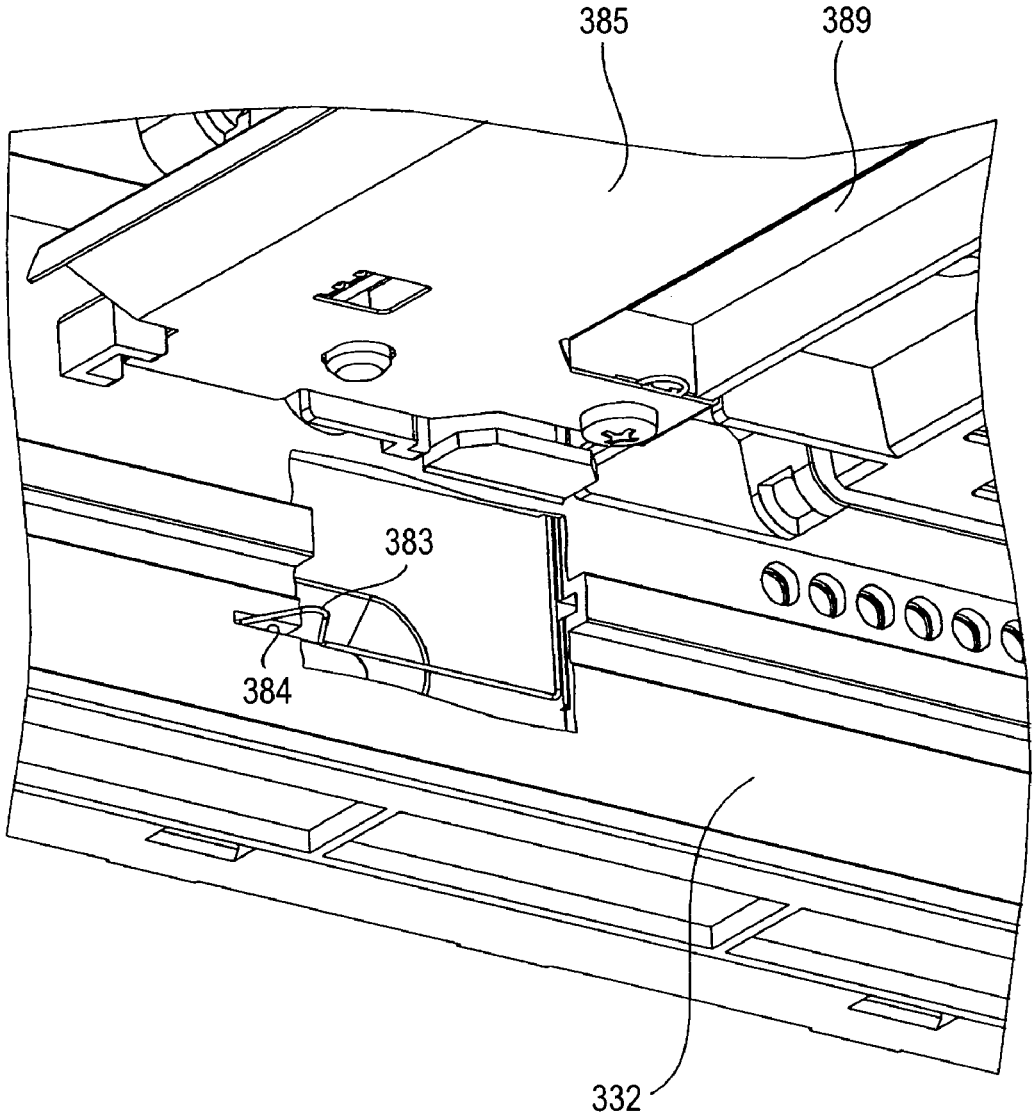
FIG. 25 is a perspective view of essential portions showing the configuration of a presser-plate ground contact shown in FIG. 22.

As shown in FIG. 25, the presser-plate ground contact 383 is formed by crooking a wire piece substantially in an angular shape, and it is protruded widthwise inwards from a slit 384 which is formed in the inner side surface of the right frame 332 so as to extend in the front and rear direction. The presser-plate ground contact 383 is elastically deformable in the widthwise direction. When the paper feed tray 208 is to be mounted in the body casing 202, the presser-plate ground contact 383 is elastically deformed so as to withdraw into the slit 384, and it is slid relative to the right sidewall 263 of the paper feed tray 208. When the paper feed tray 208 has been mounted in the body casing 202, the presser-plate ground contact 383 advances from the slit 384, and it is fitted into the ground connection hole 272 of the paper feed tray 208 so as to abut on the metal-made paper presser plate 214 within the paper feed tray 208.

One end of the wire piece forming the presser-plate ground contact 383 is extended frontward along the outer side surface of the right frame 332, and is further crooked upwards so as to be connected to a sheet metal 385 which is arranged in opposition to the downstream side portion 289 of the guide plate 286 from below. Further, the sheet metal 385 is electrically connected to the low-voltage circuit board 374 (refer to FIG. 22) through a ground line not shown. Thus, when the paper feed tray 208 has been mounted in the body casing 202 to hold the presser-plate ground contact 383 in abutment on the paper presser plate 214, the paper presser plate 214 is electrically connected to the low-voltage circuit board 374 through the presser-plate ground contact 383 and the sheet metal 385, thereby to be grounded.

Figure 26:
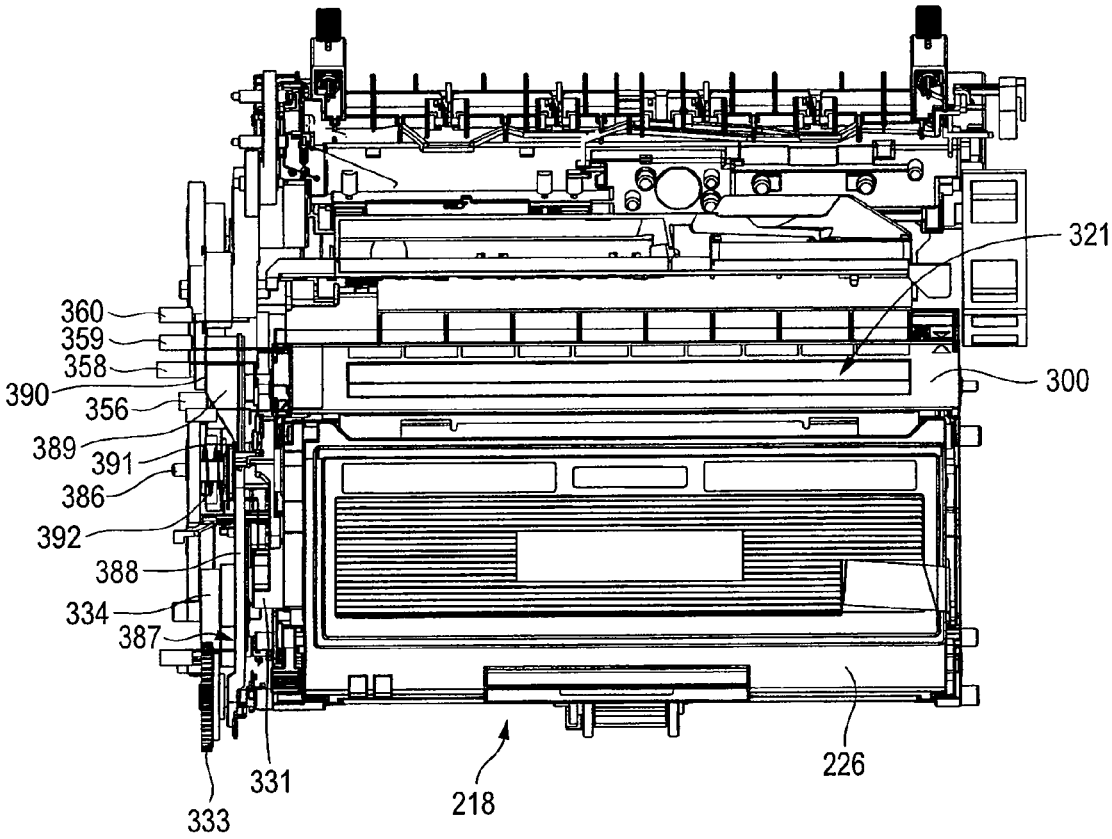
FIG. 26 is a plan view of the essential portions of the process cartridge and the left frame shown in FIG. 7.

As shown in FIG. 26, the left frame 331 is provided with a coupling member 386 being an retreatable member which is retreatably joined with the joint hole 283 (refer to FIG. 13) of the input gear 282, and an arm 387 which serves to advance or retreat the coupling member 386.

The arm 387 is disposed in front of the coupling member 386, between the left frame 331 and the gear plate 334 and on a side opposite to the side on which the electric-discharge bias output terminal 342, developing bias output terminal 344, grid bias output terminal 345 and cleaning bias output terminal 346 are disposed. The arm 387 unitarily includes an arm portion 388 that extends along the front and rear direction, and a cam portion 389 which is disposed at the rear end part of the arm portion 388.

Figure 27B:
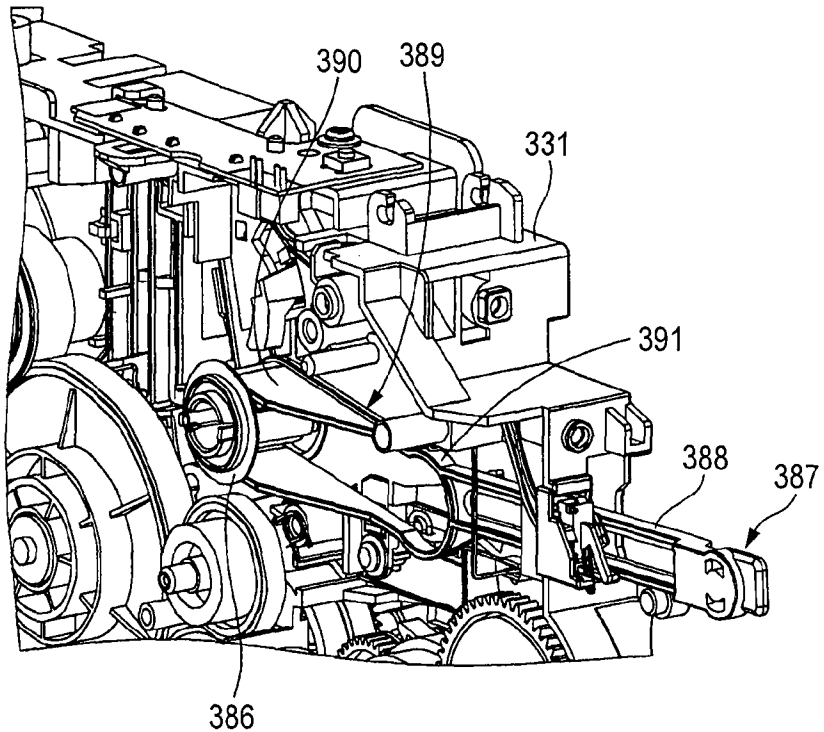
Figure 27A:
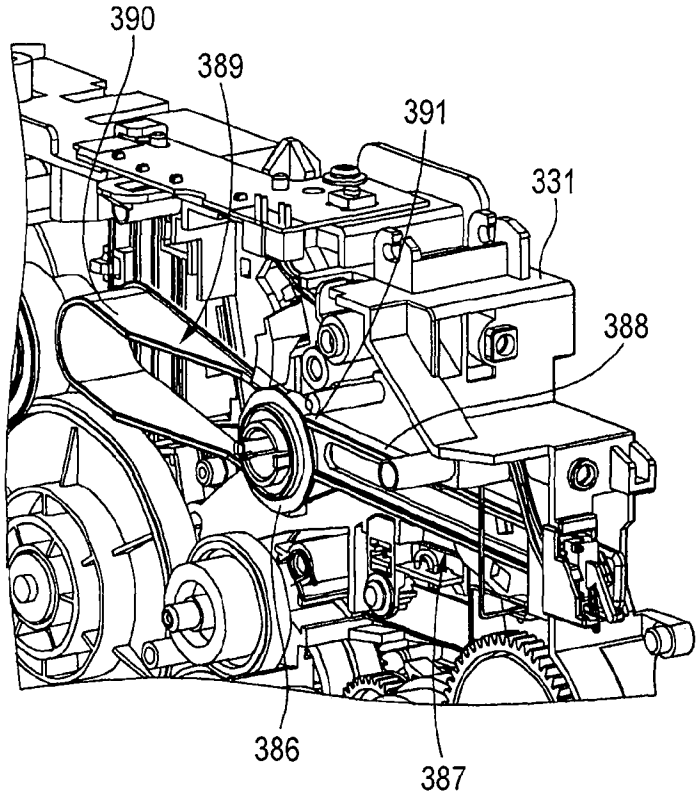

The cam portion 389 is formed with a slot that extends in the front and rear direction and through which the coupling member 386 is inserted. As shown in FIGS. 27A and 27B, a retreat portion 390 which is formed to be thick in the widthwise direction is provided around the rear end part of the slot. An advance portion 391 which is formed to be thin in the widthwise direction is provided around the front end part of the slot.

The arm 387 is supported so as to be movable in the front and rear direction along the left frame 331, in a state where the coupling member 386 is inserted through the slot at the rear end part of the arm. The arm 387 is disposed so as to move in the front and rear direction in conjunction with the opening and closure of the front cover 207.

The coupling member 386 is arranged in widthwise opposition to the joint hole 283 of the input gear 282 of the process cartridge 218 attached to the body casing 202. A rotational driving force from the motor 337 (refer to FIG. 15) disposed within the body casing 202 is input to the coupling member 386. The coupling member 386 is normally urged inwards in the widthwise direction, that is, toward the joint hole 283 by an urging spring 392 (refer to FIG. 20).

When the front cover 207 is opened in attaching or detaching the process cartridge 218 to or from the body casing 202, the arm 387 is moved frontward in conjunction with the opening of the front cover 207, and the retreat portion 390 comes into engagement with the coupling member 386 as shown in FIG. 27B. Then, the coupling member 386 is retreated from the joint hole 283 of the input gear 282 against the urging force of the urging spring 392.

When the front cover 207 is closed after the attachment of the process cartridge 218 to the body casing 202, the arm 387 is moved rearwards in conjunction with the closure of the front cover 207, the advance portion 391 comes into engagement with the coupling member 386 as shown in FIG. 27A. Then, the coupling member 386 is advanced into the joint hole 283 of the input gear 282 by the urging force of the urging spring 392 so as to be joined relatively unrotatably. Thus, a driving force from the coupling member 386 is transmitted to the input gear 282, and the feed roller 237, developing roller 238 and agitator 243 are rotated by the driving force transmitted to the input gear 282.

As described above, in the laser printer 201, the high-voltage circuit board 335 has, at least, its part arranged so as not to overlap the gear plate 334 in the widthwise direction, and the electric-discharge bias output terminal 342, transfer bias output terminal 343, developing bias output terminal 344, grid bias output terminal 345 and cleaning bias output terminal 346 are arranged at that part of the high-voltage circuit board 335 which does not overlap the gear plate 334. Therefore, notwithstanding that reduction in the size of the laser printer 201 can be attained by arranging the high-voltage circuit board 335 and the gear plate 334 on the outer side surface of the left frame 331, the biases at the periphery of the gear plate 334 can be prevented from leaking.

The electric-discharge bias output terminal 342, developing bias output terminal 344, grid bias output terminal 345 and cleaning bias output terminal 346 are juxtaposed along the end edge of the high-voltage circuit board 335 in those regions of the high-voltage circuit board 335 which do not overlap the gear plate 334 in the widthwise direction. Therefore, the distances between these terminals and the gear plate 334 can be held large, and the biases at the periphery of the gear plate 334 can be more prevented from leaking.

Further, that upper end part of the gear plate 334 which opposes to the connection members 356, 358, 359 and 360 in the up and down direction and which overlaps the high-voltage circuit board 335 in the widthwise direction is covered with the insulating sheet 373. Therefore, the high-voltage circuit board 335 and the gear plate 334 can be insulated. Consequently, the biases at the periphery of the gear plate 334 can be reliably prevented from leaking.

The distance at which the leakage does not occur between the electric-discharge bias output terminal 342 and the transfer bias output terminal 343 is ensured between these bias output terminals. Therefore, the leakage between the electric-discharge bias output terminal 342 and the transfer bias output terminal 343 can be prevented from occurring.

The distance between the electric-discharge bias output terminal 342 and the transfer bias output terminal 343 is held longer than each of the distances between the electric-discharge bias output terminal 342 and the developing bias output terminal 344, grid bias output terminal 345 and cleaning bias output terminal 346. Therefore, the leakage between the electric-discharge bias output terminal 342 and the transfer bias output terminal 343 can be more prevented from occurring.

The rib 367 is interposed between the connection member 356 to which the electric-discharge bias output terminal 342 opposes and the connection member 358 to which the developing bias output terminal 344 opposes, so that the leakage is preventable therebetween.

The rib 367 serves also as the guide unit that guides the electric-discharge bias output terminal 342 so as to abut on the connection member 356, when the high-voltage circuit board 335 is to be mounted on the outer side surface of the left frame 331. Therefore, notwithstanding that the electric-discharge bias output terminal 342 can be reliably connected to the connection member 356 in abutment, simplification in configuration and decrease in the number of components can be attained. Further, in the connecting job, the charging transformer 339 may be held in sliding friction with the front end face 367A of the rib 367, so that a job efficiency in the case of causing the electric-discharge bias output terminal 342 to abut on the connection member 356 can be enhanced. The rib 367 is formed with the slant surface 367C, so that the charging transformer 339 can be reliably held in sliding friction with the front end face 367A of the rib 367 when the electric-discharge bias output terminal 342 is caused to abut on the connection member 356.

The wire contact 361, transfer contact 362, developing roller contact 363, grid contact 364 and cleaning contact 365 are disposed on the inner side surface of the left frame 331. Therefore, the lengths of the wiring lines 368, 369, 370, 371 and 372 for connecting these contacts with the electric-discharge bias output terminal 342, transfer bias output terminal 343, developing bias output terminal 344, grid bias output terminal 345 and cleaning bias output terminal 346, respectively, can be shortened, and simplifications in wiring structures can be attained.

When the process cartridge 218 has been attached to the body casing 202, the drum ground electrode 273 disposed on the left side surface of the process cartridge 218 abuts on the drum ground contact 366 arranged on the inner side surface of the left frame 331, whereby the drum shaft 233 of the photosensitive drum 228 can be grounded through the drum ground electrode 273, drum ground contact 366 and gear plate 334. Therefore, the grounding of the drum shaft 233 of the photosensitive drum 228 can be achieved by the simple configuration.

The arm 387 for advancing and retreating the coupling member 386 is disposed in front of the coupling member 386 on the side opposite to the side on which the electric-discharge bias output terminal 342, developing bias output terminal 344, grid bias output terminal 345 and cleaning bias output terminal 346 are disposed. Therefore, the arm 387 moving in the front and rear direction and the respective bias output terminals can be prevented from interfering.

The arm 387 is arranged in the space between the left frame 331 and the gear plate 334, and the space between the left frame 331 and the gear plate 334 can be effectively used as the space for arranging the arm 387.

The high-voltage circuit board 335 is arranged so that its surface on which the charging transformer 339 are mounted may face the side of the gear plate 334. Therefore, and the charging transformer 339 can be prevented from protruding to the widthwise exterior of the high-voltage circuit board 335. Consequently, the widthwise size of the laser printer 201 can be made still smaller. As a result, further reduction in the size of the laser printer 201 can be attained.

The comparatively tall components such as the charging transformer 339 are arranged at that part of the high-voltage circuit board 335 which does not overlap the gear plate 334 in the widthwise direction. Therefore, the tall components are arranged so as to overlap the gear plate 334 in the direction orthogonal to the widthwise direction, whereby the interval between the gear plate 334 and the high-voltage circuit board 335 can be narrowed. Consequently, the widthwise size of the laser printer 201 can be made still smaller, and further reduction in the size of the laser printer 201 can be attained.

The bias output terminals of the high-voltage circuit board 335 and the contacts arranged on the inner side surface of the left frame 331 are electrically connected through the respectively corresponding connection members 356, 357, 358, 359 and 360, while bypassing the gear plate 334. Therefore, wiring lines for connecting the respective bias output terminals and the corresponding contacts need not be penetrated through the gear plate 334. As a result, simplifications in the wiring structures for the electrical connections between the respective bias output terminals and the corresponding contacts can be attained.

Each of the connection members 356, 357, 358, 359 and 360 can be made the simple configuration in which the wire piece is wound.

The paper feed tray 208 is mounted in the body casing 202, and the presser-plate ground contact 383 abuts on the paper presser plate 214, whereby the paper presser plate 214 can be electrically connected to the low-voltage circuit board 374 through the presser-plate ground contact 383 and the sheet metal 385 and can be grounded through the low-voltage circuit board 374. Therefore, the grounding of the paper presser plate 214 can be achieved by the simple configuration.

The paper feed tray 208 has its dismounting from the body casing 202 regulated by the cooperation between the lever-driving-force transmission gear 377 and the tray lock piece 279. Therefore, the tray lock piece 279 need not be disposed in the left frame 331, and the configuration for regulating the dismounting of the paper feed tray 208 can be simplified.

The wire contact 361, transfer contact 362, developing roller contact 363, grid contact 364 and cleaning contact 365 for the electrical connections with the process cartridge 218, and the driving system (motor 337 and transmission gear 338) of the process cartridge 218 are concentratively arranged on the left frame 331. Therefore, design restrictions to the right frame 332 can be relieved. Consequently, the right frame 332 can be designed so as to be capable of stably holding the process cartridge 218. With such a design, the process cartridge 218 can be stably held, so that the stable feeds of electric power and driving forces to the process cartridge 218 can be achieved.

In the above description, there are described in detail of two independent embodiments of the first and the second embodiments to which the present invention is applied. However, one skilled in the art may arbitrary combine the subject matters included in the two embodiments to thereby provide an image forming apparatus having the advantages described above with respect to the two embodiments.

The foregoing description of the embodiments has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

a first sidewall and a second sidewall that are arranged in opposition at a predetermined interval therebetween;

an image forming unit that forms an image on a recording medium and being arranged between the first sidewall and the second sidewall;

a drive source that is arranged on a side of the first sidewall with respect to the image forming unit, and generates a driving force for the image forming unit;

a first gear that transmits the driving force from the drive source to the image forming unit;

a gear plate that is arranged on a side of the first sidewall facing the image forming unit, and supports the first gear; and a high-voltage circuit board that is arranged on the first sidewall, and generates a bias to be applied to the image forming unit, the high-voltage circuit board having a first region arranged in opposition to the gear plate in a direction in which the first sidewall opposes the second sidewall, and a second region that does not overlap the gear plate in the direction in which the first sidewall opposes the second sidewall, wherein the high-voltage circuit board comprises a supply-voltage output terminal that outputs the bias, the supply-voltage output terminal being arranged at the second region.

2. The image forming apparatus according to claim 1, wherein the supply-voltage output terminal is arranged at an end edge of the second region of the high-voltage circuit board.

3. The image forming apparatus according to claim 1 further comprising an insulating sheet that covers an overlapping portion of the gear plate, the overlapping portion overlapping the high-voltage circuit board in the opposing direction.

4. The image forming apparatus according to claim 1, wherein the image forming unit includes:

a photosensitive member that carries a developing agent image;

a charging unit having a wire and that charges the photosensitive member; and a transfer unit that transfers the developing agent image carried on the photosensitive member onto the recording medium, wherein the supply-voltage output terminal includes:

an electric-discharge bias output terminal that outputs an electric-discharge bias to the wire; and a transfer bias output terminal that outputs a transfer bias to the transfer unit, and wherein the electric-discharge bias output terminal and the transfer bias output terminal are arranged at a distance at which leakage does not occur therebetween.

5. The image forming apparatus according to claim 1, wherein the image forming unit includes:

a photosensitive member;

a charging unit having a wire and a grid and that charges the photosensitive member;

a developing unit that develops an electrostatic latent image formed on the photosensitive member;

a transfer unit that transfers a developing agent image carried on the photosensitive member onto the recording medium; and a cleaning unit that cleans the photosensitive member, wherein the supply-voltage output terminal includes:

an electric-discharge bias output terminal that outputs an electric-discharge bias to the wire;

a transfer bias output terminal that outputs a transfer bias to the transfer unit; and a third bias output terminal that outputs at least one of a grid bias being output to the grid, a developing bias being output to the developing unit, and a cleaning bias being output to the cleaning unit, and wherein a distance between the electric-discharge bias output terminal and the transfer bias output terminal is configured to be longer than at least one of a distance between the electric-discharge bias output terminal and the third bias output terminal, and a distance between the transfer bias output terminal and the third bias output terminal.

6. The image forming apparatus according to claim 1, wherein the image forming unit includes:

a photosensitive member;

a charging unit that charges the photosensitive member;

a developing unit that develops an electrostatic latent image formed on the photosensitive member; and a transfer unit that transfers a developing agent image carried on the photosensitive member onto the recording medium, wherein the supply-voltage output terminal includes:

a charging bias output terminal that outputs a charging bias to the charging unit;

a transfer bias output terminal that outputs a transfer bias to the transfer unit; and a developing bias output terminal that outputs a developing bias to the developing unit, and wherein a distance between the charging bias output terminal and the transfer bias output terminal is configured to be longer than at least one of a distance between the charging bias output terminal and the developing bias output terminal, and a distance between the transfer bias output terminal and the developing bias output terminal.

7. The image forming apparatus according to claim 1, wherein the image forming unit includes:

a photosensitive member;

a charging unit having a wire and a grid and that charges the photosensitive member;

a developing unit that develops an electrostatic latent image formed on the photosensitive member;

a transfer unit that transfers a developing agent image carried on the photosensitive member onto the recording medium; and a cleaning unit that cleans the photosensitive member, wherein the supply-voltage output terminal includes:

an electric-discharge bias output terminal that outputs an electric-discharge bias to the wire; and a second bias output terminal that outputs at least one of a transfer bias being output to the transfer unit, a grid bias being output to the grid, a developing bias being output to the developing unit, and a cleaning bias being output to the cleaning unit, and wherein the image forming apparatus further comprises:

a first conductor that is disposed at the first sidewall and connected to the electric-discharge bias output terminal;

a second conductor that is disposed at the first sidewall and connected to the second bias output terminal; and a shield member that is interposed between the first conductor and the second conductor at the first sidewall, and prevents leakage from occurring between the first conductor and the second conductor.

8. The image forming apparatus according to claim 1 wherein the image forming unit includes:

a photosensitive member;

a charging unit that charges the photosensitive member;

a developing unit that develops an electrostatic latent image formed on the photosensitive member; and a transfer unit that transfers a developing agent image carried on the photosensitive member onto the recording medium, wherein the supply-voltage output terminal includes:

a charging bias output terminal that outputs a charging bias to the charging unit; and a second bias output terminal that outputs at least one of a transfer bias being output to the transfer unit and a developing bias being output to the developing unit, and wherein the image forming apparatus further comprises:

a first conductor that is disposed at the first sidewall and connected to the charging bias output terminal;

a second conductor that is disposed at the first sidewall and connected to the second bias output terminal; and a shield member that is interposed between the first conductor and the second conductor at the first sidewall, and prevents leakage from occurring between the first conductor and the second conductor.

9. The image forming apparatus according to claim 8, wherein the charging unit includes a wire and a grid, wherein the charging bias output terminal includes an electric-discharge bias output terminal that outputs an electric-discharge bias to the wire, and wherein the first conductor includes a conductor connected to the electric-discharge bias output terminal.

10. The image forming apparatus according to claim 7, wherein the shield member guides a movement of the electric-discharge bias output terminal when the electric-discharge bias output terminal is connected to the first conductor.

11. The image forming apparatus according to claim 10, wherein the high-voltage circuit board is provided with a charging transformer that generates the electric-discharge bias, wherein the electric-discharge bias output terminal is arranged above the charging transformer, and wherein the shield member is arranged at a position that the shield member slidably contacts with the charging transformer when the electric-discharge bias output terminal is connected to the first conductor.

12. The image forming apparatus according to claim 1, wherein the image forming unit includes a photosensitive member, and wherein the photosensitive member is grounded through the gear plate.

13. The image forming apparatus according to claim 1 further comprising:

an openable cover that opens and closes an opening formed between the first sidewall and the second sidewall;

an retreatable member that advances inwards in the opposing direction from the first sidewall to a joint position in which the retreatable member transmits the driving force to the image forming unit, and retreats outwards in the opposing direction from the joint position to a release position in which the transmission of the driving force to the image forming unit is released; and an arm that is arranged between the openable cover and the retreatable member, the arm causing the retreatable member to advance and retreat in conjunction with the opening or closing of the openable cover, wherein the supply-voltage output terminal is arranged on a side opposite to a side on which the arm is disposed, with respect to the retreatable member.

14. The image forming apparatus according to claim 1, wherein the high-voltage circuit board is provided with a transformer that protrudes toward the gear plate.

15. The image forming apparatus according to claim 14, wherein the transformer is provided in the second region.

16. The image forming apparatus according to claim 1 further comprising a contact that is arranged on the side of the first sidewall with respect to the image forming unit, the contact being connected for applying the bias to the image forming unit.

17. The image forming apparatus according to claim 16 further comprising a connection member that is arranged in opposition to the first sidewall and the high-voltage circuit board with the gear plate interposed therebetween, the connection member electrically connecting the contact and the high-voltage circuit board while avoiding the gear plate.

18. The image forming apparatus according to claim 17, wherein the connection member is made of a wire piece.

19. The image forming apparatus according to claim 17 further comprising:

an openable cover that opens and closes an opening formed between the first sidewall and the second sidewall;

an retreatable member that advances inwards in the opposing direction from the first sidewall to a joint position in which the retreatable member transmits the driving force to the image forming unit, and retreats outwards in the opposing direction from the joint position to a release position in which the transmission of the driving force to the image forming unit is released; and an arm that is arranged between the openable cover and the retreatable member, the arm causing the retreatable member to advance and retreat in conjunction with the opening or closing of the openable cover, wherein the arm is arranged between the first sidewall and the gear plate.

20. The image forming apparatus according to claim 1 further comprising:

a low-voltage circuit board that is arranged on the side of the second sidewall with respect to the image forming unit, and generates a voltage lower than that generated by the high-voltage circuit board;

a placement plate on which sheets of the recording medium to be formed the image thereon by the image forming unit are placed; and a ground contact that is electrically connected to the low-voltage circuit board and is disposed protruding from the second sidewall, the ground contact being in contact with the placement plate.

21. The image forming apparatus according to claim 1 further comprising:

a placement plate on which sheets of the recording medium to be formed the image thereon by the image forming unit are placed;

a cassette that accommodates the placement plate therein, and is detachably attached between the first sidewall and the second sidewall;

a lock mechanism that is disposed at the second sidewall, and regulates detachment of the cassette; and a second gear that is disposed at the first sidewall, and moves the placement plate from a placement position for placing the recording medium, to a conveyance position for conveying the recording medium, wherein the second gear rotates in a direction in which the cassette is urged in an attachment direction of the cassette, and wherein the detachment of the cassette from between the first sidewall and the second sidewall is regulated by cooperation of the lock mechanism and the second gear.

* * * * *